US011705011B2

(12) United States Patent
Turcios et al.

(10) Patent No.: US 11,705,011 B2
(45) Date of Patent: Jul. 18, 2023

(54) ASSIGNED SPACING TO VISUAL SEPARATION AUTO TRANSITION

(71) Applicant: Rockwell Collins, Inc., Cedar Rapids, IA (US)

(72) Inventors: Felix B. Turcios, Cedar Rapids, IA (US); Randy H. Jacobson, Melbourne, FL (US); Bryan C. Schultz, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 223 days.

(21) Appl. No.: 17/177,034

(22) Filed: Feb. 16, 2021

(65) Prior Publication Data

US 2022/0262264 A1 Aug. 18, 2022

(51) Int. Cl.
*G08G 5/00* (2006.01)

(52) U.S. Cl.
CPC ..... *G08G 5/0078* (2013.01); *G08G 5/006* (2013.01); *G08G 5/0021* (2013.01)

(58) Field of Classification Search
CPC .... G08G 5/0078; G08G 5/0021; G08G 5/006; G08G 5/0008; G08G 5/0013; G08G 5/0052; G08G 5/025
See application file for complete search history.

(56) References Cited

U.S. PATENT DOCUMENTS

| | | | | |
|---|---|---|---|---|
| 7,194,342 | B1 | 3/2007 | Horvath et al. | |
| 8,629,787 | B1 | 1/2014 | Rathinam et al. | |
| 9,082,300 | B2 | 7/2015 | Scott | |
| 9,142,133 | B2 | 9/2015 | Palanisamy et al. | |
| 9,437,112 | B1 | 9/2016 | Greene | |
| 2015/0120177 | A1 | 4/2015 | Palanisamy et al. | |
| 2016/0358481 | A1 | 12/2016 | Vesely et al. | |
| 2017/0103660 | A1 * | 4/2017 | Shafaat | B64D 45/04 |
| 2020/0312160 | A1 | 10/2020 | Manberg et al. | |
| 2020/0339275 | A1 | 10/2020 | Barber et al. | |

FOREIGN PATENT DOCUMENTS

| | | | | |
|---|---|---|---|---|
| EP | 3428903 | A1 * | 1/2019 | B64D 43/00 |

OTHER PUBLICATIONS

Extended Search Report in European Application No. 22156966.8 dated Jul. 11, 2022, 15 pages.

* cited by examiner

*Primary Examiner* — Shon G Foley
(74) *Attorney, Agent, or Firm* — Suiter Swantz pc llo

(57) ABSTRACT

A system and method for an ownship aircraft auto transition from an assigned spacing application to a visual separation application provides the ability to intuitively pre-configure for and execute an automatic transition from an assigned spacing traffic application managing an assigned interval spacing to a traffic application managing visual separation from an assigned target aircraft. This feature enables integration between separate traffic applications, creating new capabilities while reducing the workload on the pilot during a particularly busy phase of flight.

15 Claims, 26 Drawing Sheets

300

400

ASSIGNED SPACING TO VISUAL SEPARATION AUTO TRANSITION

BACKGROUND

Advanced traffic applications are being defined in industry for the purpose of improving airspace efficiency through tighter and more consistent spacing between aircraft. Although their overall objective is the same, these applications are tailored to specific operations. For example, achieving a specific spacing interval regardless of visibility may be one element of Flight-deck Interval Management (FIM) whereas maintaining visual separation with the assistance of the traffic displays available in the cockpit may be one element of Cockpit Display of Traffic Information (CDTI)-Assisted Visual Separation (CAVS).

For a given arrival standard terminal arrival (STAR) and approach to an airport, Air Traffic Control (ATC) may assign the pilot a FIM clearance during the arrival and initial approach phase to ensure that a specific, assigned, spacing interval between the lead and the trailing aircraft is met. Once the traffic flow has been pre-conditioned in this manner, ATC may issue a visual separation clearance behind the same leading aircraft for the remainder of the approach. If the conditions are appropriate and the aircraft is so-equipped, the pilot may then use CAVS to assist in the execution of that visual separation clearance.

The transition between the assigned spacing operation FIM and the visual separation operation CAVS usually occurs during a busy phase of flight. The aircrew will likely be in the middle of, or about to start, configuring the aircraft for landing (e.g., reduce airspeed, extend flaps, extend landing gear, complete checklists). In order to accomplish the transition FIM to CAVS, the crew must exit the FIM Application, visually confirm the location and state of the leading aircraft, then open, configure, and activate the CAVS Application.

In high workload environments (e.g., just prior to landing), the aircrew is tasked with a plurality of regulatory and safety related mandatory checklists and procedures. Additional heads down or screen time may result in distraction from safety related tasks. Should an aircrew become task saturated in this high workload environment, negative results may occur.

Therefore, a need remains for a system and related method which may overcome these limitations and provide a novel solution to enable auto transition between an assigned separation cockpit application and a visual separation cockpit application.

SUMMARY

In one embodiment of the inventive concepts disclosed herein, a system for aircraft auto transition from assigned spacing to visual separation may comprise a communication system onboard an ownship aircraft, the communication system configured at least for receiving a position, an altitude, an identification, and a velocity of a target aircraft. The system may further include a cockpit display onboard the ownship aircraft, the cockpit display configured for display of at least one of: 1) a primary flight display (PFD), 2) a navigation display (ND), 3) a user interface, 4) an interval management display (IMD) associated with an assigned spacing application, 5) an assigned spacing data block and an assigned spacing symbology associated with the assigned spacing application, and 6) a visual separation data block and a visual separation symbology associated with a visual separation application, the user interface further configured for a user interaction and a user selection.

For control, the system may include a controller onboard the ownship aircraft, the controller operatively coupled with each of the communication system and the cockpit display and a tangible, non-transitory memory configured to communicate with the controller, the tangible, non-transitory memory having instructions stored therein that, in response to execution by the controller, cause the controller to carry out the function of the system.

In function, the controller may receive, via the communication system, the position, the altitude, the identification, and the velocity of at least one of the target aircraft and receive an interval clearance assigning the target aircraft as an interval for the ownship aircraft, the interval clearance including a termination point (TP). The controller may display the assigned spacing data block and the assigned spacing symbology on the cockpit display and display an interval status message on the cockpit display, the interval status message including an indication of either the assigned spacing application or the visual separation application.

The controller may further display, on the cockpit display, an auto option for the user selection of an auto transition from the assigned spacing application to the visual separation application and receive the user selection of the auto transition. The controller may also display, on the cockpit display, a range option for the user selection of a reference range for visual separation (RR) between the ownship aircraft and the target aircraft, the RR one of: a distance to the target aircraft at the TP and a user selectable range to the target aircraft and receive the user selection of the RR.

At the TP, the controller may automatically transition from the assigned spacing application to the visual separation application at the TP without the user interaction, the auto transition including a data handover from the assigned spacing application to the visual separation application, the data handover including the position, the altitude, the identification, and the velocity of the target aircraft and the RR and discontinue the display of the assigned spacing data block and the assigned spacing symbology on the cockpit display.

The controller may display the visual separation data block and the visual separation symbology on the cockpit display and display the indication of the visual separation application on the cockpit display.

An additional embodiment of the inventive concepts disclosed herein may be directed to a method for aircraft auto transition from assigned spacing to visual separation. The method may include receiving, via a communication system onboard an ownship aircraft, a position, an altitude, an identification, and a velocity of a target aircraft and receiving an interval clearance assigning the target aircraft as an interval for the ownship aircraft, the interval clearance associated with at least one of an assigned spacing application and a visual separation application, the interval clearance including a termination point (TP).

The method may also include displaying, on a cockpit display, an assigned spacing data block and an assigned spacing symbology, each associated with the assigned spacing application and displaying, on the cockpit display, an auto option for a user selection of an auto transition from the assigned spacing application to the visual separation application. The method may also include receiving the user selection of the auto transition.

The method may further include displaying, on the cockpit display, a range option for the user selection of a reference range for visual separation (RR) between the ownship aircraft and the target aircraft, the RR one of: a distance to the target aircraft at the TP and a user selectable range to the target aircraft and receiving the user selection of the RR.

The method may include automatically transitioning from the assigned spacing application to the visual separation application at the TP without the user selection, the auto transition including a data handover from the assigned spacing application to the visual separation application, the data handover including the position, the altitude, the identification, the RR, and the velocity of the target aircraft, discontinuing the display of the assigned spacing data block and the assigned spacing symbology on the cockpit display and displaying, on the cockpit display, a visual separation data block and a visual separation symbology, each associated with the visual separation application.

It is to be understood that both the foregoing general description and the following detailed description are exemplary and explanatory only and are not necessarily restrictive of the inventive concepts as claimed. The accompanying drawings, which are incorporated in and constitute a part of the specification, illustrate embodiments of the inventive concepts and together with the general description, serve to explain the principles of the inventive concepts disclosed herein.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated, and some features may be omitted or may be represented schematically in the interest of clarity. Like reference numerals in the drawings may represent and refer to the same or similar element, feature, or function. In the drawings in which.

DETAILED DESCRIPTION OF EXEMPLARY EMBODIMENTS

Figure 1:
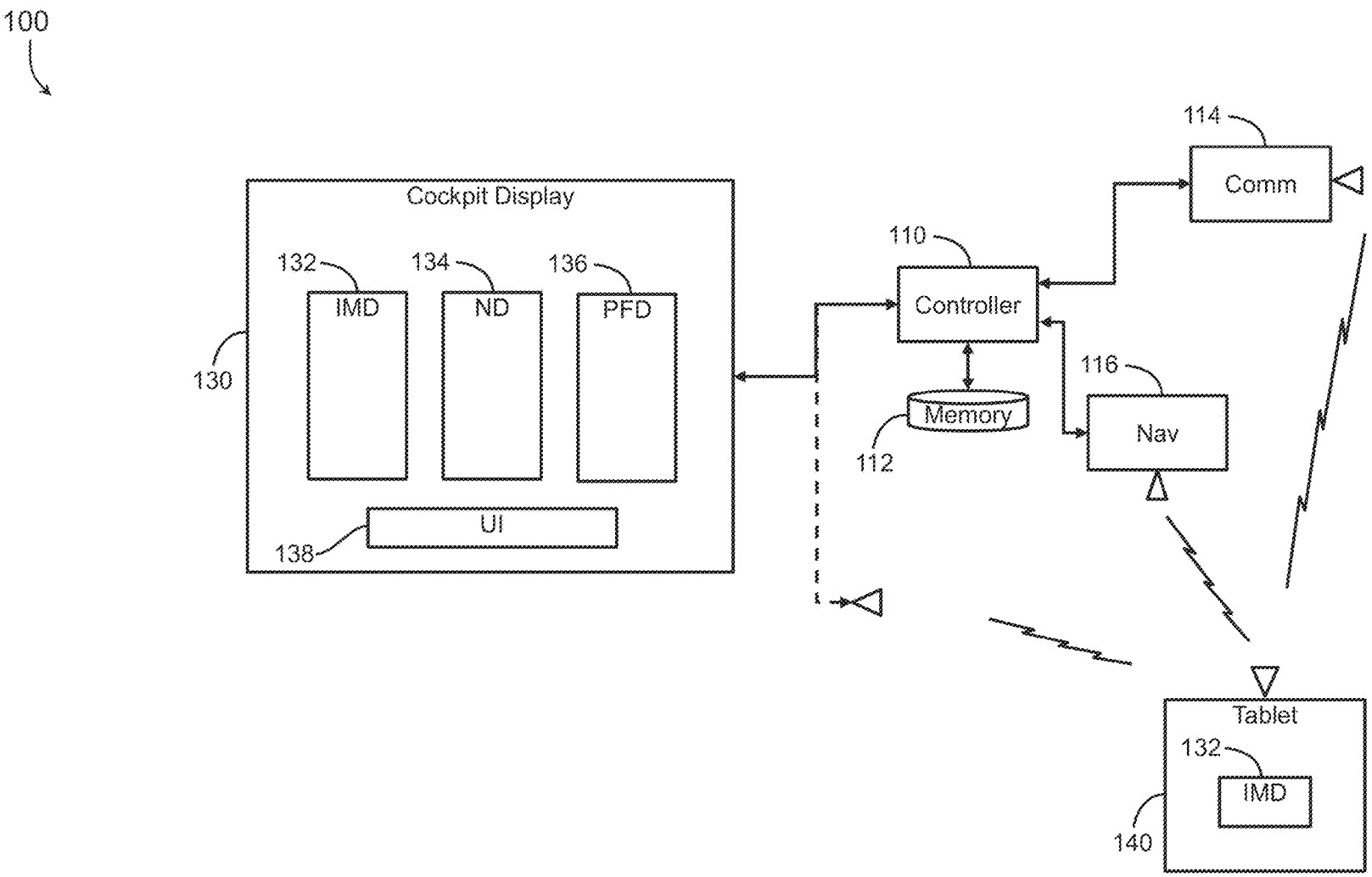
FIG. 1 is a diagram of a system for aircraft auto transition from assigned spacing to visual separation in accordance with an embodiment of the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

As used herein the term "approximately" in claim language as well as specification language may refer to a range of values plus or minus twenty percent (+/−20%) of the claimed value. For example, "approximately 100" may refer to, and therefore claim, the range of 80 to 120.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, thus "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Overview

Broadly, embodiments of the inventive concepts disclosed herein are directed to a system and method enabling an ownship aircraft auto transition from an assigned spacing application to a visual separation application. The system may provide the ability to intuitively pre-configure for and execute an automatic transition from an assigned traffic application managing an assigned interval spacing to a traffic application managing visual separation from an assigned target aircraft. This feature enables integration between separate traffic applications, creating new capabilities while reducing the workload on the pilot during a particularly busy phase of flight.

| REFERENCE CHART | |
|---|---|
| 100 | System for Auto Transition from Assigned Spacing to Visual Separation |
| 110 | Controller |
| 112 | Memory |
| 114 | Communication System |
| 116 | Navigation System |
| 120 | Ownship Aircraft |
| 130 | Cockpit Display |
| 132 | Interval Management Display (IMD) |
| 134 | Navigation Display (ND) |
| 136 | Primary Flight Display (PFD) |
| 138 | User Interface |
| 200 | Information Layer |
| 214 | Interval Clearance |
| 216 | TP Indication |
| 220 | Assigned Spacing Application |
| 222 | Data Handover |
| 224 | Visual Separation Application |
| 230 | Cockpit Display Information |
| 300 | Route Overview |
| 320 | Target Aircraft |
| 330 | Route |
| 332 | Achieve by Point (ABP) (EPGIP) |
| 334 | Termination Point (TP) (EGDUT) |
| 336 | Destination (SBGL) |
| 400 | IM Clearance Entry Sequence |
| 402 | Auto Transition Selection |
| 404 | Auto Transition Setup |
| 406 | Select Distance at TP |
| 408 | Custom Distance Selection |
| 410 | Reference Range for Visual Separation (RR) |
| 412 | Keypad |
| 432 | RR Selection Page |
| 500 | Interval Management Examples |
| 502 | Assigned spacing Data Block |
| 504 | Assigned spacing Symbology |
| 506 | Auto Transition Armed Message |
| 508 | Terminate Option |
| 512 | Assigned spacing Data Block Removed |
| 516 | Terminate Auto Message |
| 520 | Target Aircraft Callsign |
| 522 | Visual Separation Data Block |
| 524 | Visual Separation Symbology |
| 532 | Alternate Interval Management Page |
| 534 | PFD Abbreviated Mnemonic |
| 536 | Alternate Auto Transition Armed Message |
| 600 | Arrival Sequence |
| 700 | Method Flow |

FIG. 1 System

Figure 3:
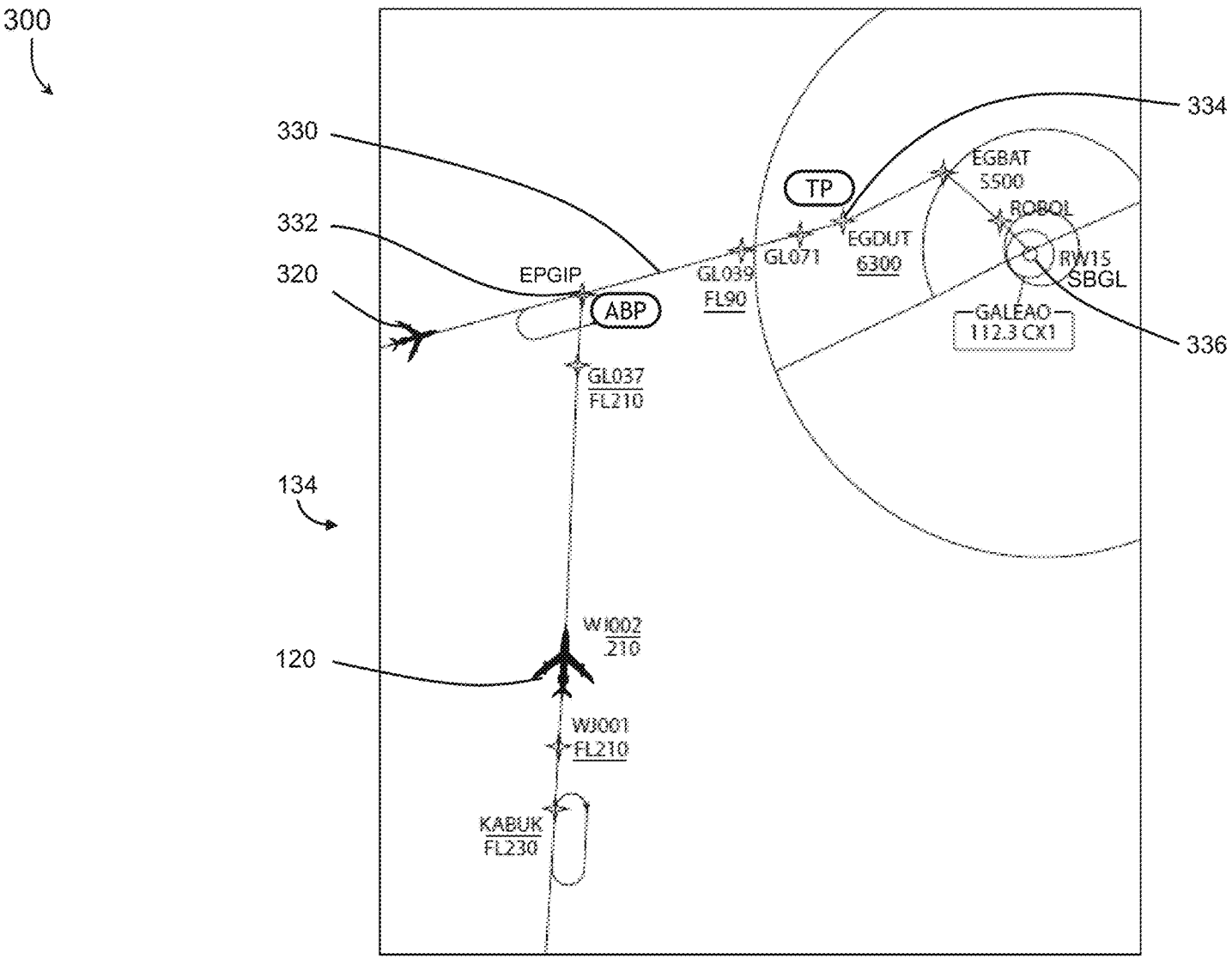
FIG. 3 is a diagram of a route overview exemplary of an embodiment of the inventive concepts disclosed herein.

Referring to FIG. 1, a diagram of a system for aircraft auto transition from assigned spacing to visual separation 100 in accordance with an embodiment of the inventive concepts disclosed herein is shown. Generally, the system for aircraft auto transition from assigned spacing to visual separation 100 may include a controller 110, a memory 112, a communication system 114, a navigation system 116 and a cockpit display 130. The cockpit display may be configured to present an interval management display (IMD) 132, a navigation display (ND) 134, a primary flight display (PFD) 136 accessible by a pilot via a user interface 138. Each of the elements of system for aircraft auto transition from assigned spacing to visual separation 100 may be sited onboard an ownship aircraft 120 (FIG. 3).

In one embodiment of the inventive concepts disclosed herein, the system for aircraft auto transition from assigned spacing to visual separation 100 may function to auto transition from an assigned spacing application to a visual separation application enabling a seamless transition within the flight deck of the ownship aircraft 120. The system may enable an execution of an automatic background hand-off between separate traffic applications.

As used herein, the terms assigned spacing application and FIM may be used interchangeably. Similarly, the terms visual spacing application and CAVS may be used interchangeably.

In one embodiment of the inventive concepts disclosed herein, the cockpit display 130 may be configured for display of 1) the PFD 136, 2) the ND 134, 3) the user interface 138, 4) the IMD 132 associated with the assigned spacing application. The cockpit display 130 may be further configured for display of an assigned spacing data block and an assigned spacing symbology associated with the assigned spacing application and a visual separation data block and a visual separation symbology associated with the visual separation application. Via the user interface 138, the cockpit display 130 may enable a user interaction and a user selection of specific elements displayed thereon.

The cockpit display 130 may include a multi-function display (MFD) operationally coupled with the aircraft and installed within the flight deck of the ownship aircraft 120, a portable display such as a temporarily mounted display visible to the pilot, and a portable tablet display 140 equipped with a radio frequency antenna and carried onboard the ownship aircraft 120 by the pilot.

In one embodiment, the portable and tablet displays 140 may wirelessly connect with each of the controller 110 as well as the communication system 114 and the navigation system 116 which may also be portable devices. In this manner, the system for aircraft auto transition from assigned spacing to visual separation 100 operating on the portable or tablet device 140 may function to carry out each step the system for aircraft auto transition from assigned spacing to visual separation 100 may provide to aid the pilots in the auto transition. In one embodiment, each of the portable display and the tablet may be in data connectivity with the ownship aircraft 120 and in data connectivity with the communication system 114 and a navigation system 116.

In some embodiments, the IMD 132 may be configured for display of the assigned and visual separation application and a plurality of submenus therein. In one embodiment, the IMD 132 may display the assigned spacing application as a flight deck interval management system (FIM) and display the visual separation application as a Cockpit Display of Traffic Information (CDTI)-Assisted Visual Separation (CAVS) application and a CDTI-Assisted Separation (CAS).

In some embodiments, the ND 134 and the PFD 136 may function normally in display of critical flight information as well as display some spacing related information and symbology as directed by the controller 110. In some exemplary embodiments, the user interface 138 may include a touch-screen capability within the cockpit display 130 as well as a mouse or trackpad interface for the pilot to select a specific area of the screen.

In one embodiment of the inventive concepts disclosed herein, the controller 110 may include a portion and a partition of a mission computer (MC), a flight control computer (FCC), a flight management system (FMS), a traffic computer (TC), and a flight deck display management computer (DMC). In one embodiment, the memory 112 may include a tangible, non-transitory memory 112 configured to communicate with the controller 110, the tangible, non-transitory memory 112 having instructions stored therein that, in response to execution by the controller 110, cause the controller 110 to carry out each function of the system for aircraft auto transition from assigned spacing to visual separation 100.

In one embodiment of the inventive concepts disclosed herein, the communication system 114 onboard the ownship aircraft may be configured for receiving a position, an altitude, an identification, and a velocity of a plurality of target aircraft. In one embodiment, the communication system 114 may include an Automatic Dependent Surveillance-Broadcast (ADS-B) system capable of reception and transmission of each element of the ADS-B data messages including reception of a rebroadcast (ADS-R) and a traffic information service broadcast (TIS-B). In one embodiment, the communication system 114 is configured for transmission and reception of both a data signal and a voice signal. For example, the ownship aircraft 120 may receive one or more spacing and or separation clearances via the communication system 114. In one exemplary embodiment, a voice signal received by a pilot onboard the ownship aircraft 120 may direct the ownship aircraft and a data signal (e.g., controller pilot data link communications (CPDLC)) may be received by the controller 110 to operate in compliance with the received clearance.

In one embodiment of the inventive concepts disclosed herein, the navigation system 116 may be sited onboard the ownship aircraft 120 and may include a traditional navigation system configured for maintaining and updating a position of the ownship aircraft 120. Contemplated herein, a traditional navigation system 116 may include a global navigation satellite system (GNSS, global positioning system (GPS) inertial navigation system (INS) and the like.

FIG. 2 Information

Figure 2:
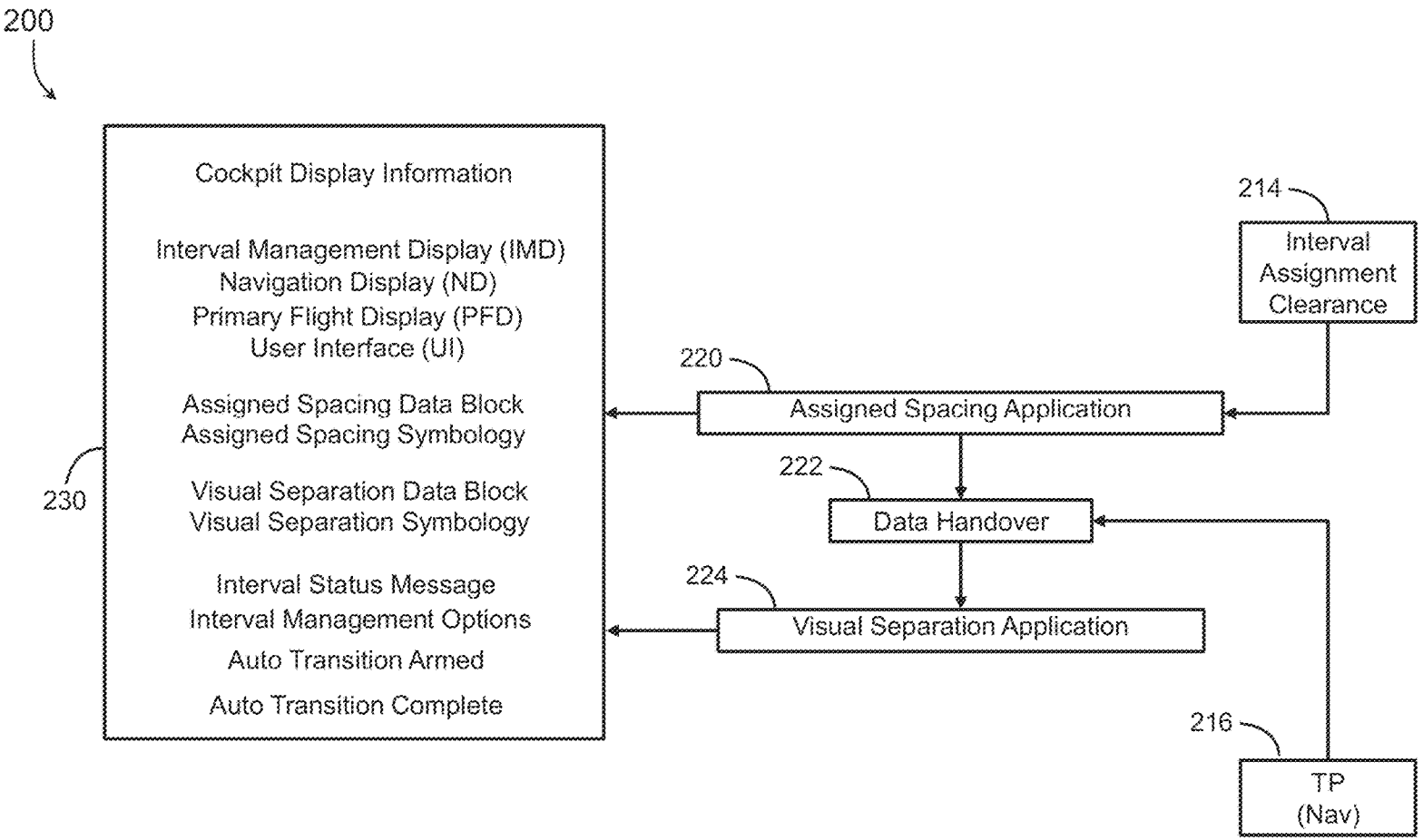
FIG. 2 is a diagram of an information layer in accordance with an embodiment of the inventive concepts disclosed herein.

Referring now to FIG. 2, a diagram of an information layer 200 in accordance with an embodiment of the inventive concepts disclosed herein is shown. The information layer diagram 200 may detail one exemplary embodiment of how the system for aircraft auto transition from assigned spacing to visual separation 100 may receive, process, and display data.

An interval clearance 214 may be issued by an air traffic control (ATC) and received by the communication system 114 (e.g., verbally, datalink, etc.) as well as input to the controller 110 by the pilot. The interval clearance 214 may include an instruction to proceed via the assigned spacing application 220 as well as the visual separation application 224 behind a target aircraft 320 (FIG. 3). In some instances, ATC may issue a clearance to the ownship aircraft to follow the assigned spacing clearance then maintain visual separation from the target aircraft 320. Information displayed on the cockpit display 130 may include cockpit display information 230 associated with the IMD 132, the ND 134, the PFD 136, and interaction between the pilot and the controller 110 via the UI 138.

Additional cockpit display information 230 may include (discussed in more detail below) the assigned spacing data block, and assigned spacing symbology, an interval status message, and a plurality of interval management options. The cockpit display information 230 may also include an auto transition armed message, an auto transition complete message, and visual separation data block and a visual separation symbology to aid the pilot in compliance with the assigned spacing clearance.

In one embodiment, the navigation system 116 may indicate arrival at a termination point (TP) 334 (FIG. 3) to the controller 110 sending a TP indication 216 enabling the controller 110 to determine a correct trigger to perform a data handover 222 from the assigned spacing application 220 to the visual separation application 224.

In an additional embodiment, the assigned spacing application 220 may not rely on the navigation system 116 for positioning information. Here, the controller 110 may calculate the TP 334 and display the calculated TP 334 on the cockpit display 130.

FIG. 3 Exemplary Route

Referring now to FIG. 3, a diagram of a route overview 300 exemplary of an embodiment of the inventive concepts disclosed herein is shown. The route overview 300 may indicate a terminal area flight of the ownship aircraft 120 from an arrival fix KABUK to a destination (SBGL) 336. An exemplary view of the ND 134 may be an overview of the route 330 the ownship aircraft 120 may fly.

Here, the ownship aircraft 120 may proceed to an achieve by point (ABP) 332 here, EPGIP where the ownship aircraft 120 must be in compliance with the interval clearance 214 (e.g., range behind, speed, etc.) in trail of the target aircraft 320. As the ownship aircraft 120 continues to SBGL, it may traverse the TP 334, here, EGDUT waypoint. The TP 334 (e.g., planned termination point) may be a point at which the interval clearance 214 directs the pilots of the ownship aircraft 120 to transition from an assigned spacing (with employment of the assigned spacing application) to a visual separation (with employment of the visual separation application).

Figure 4A:
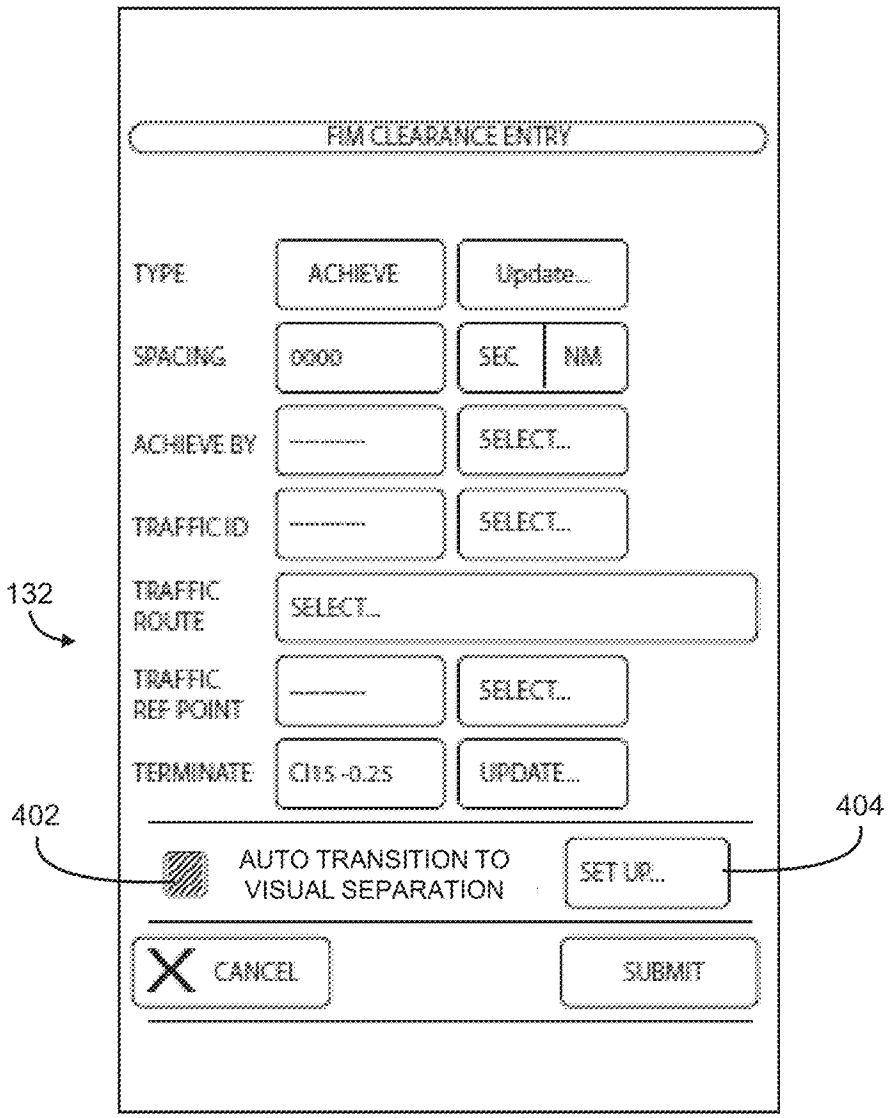
FIGS. 4A-4C are diagrams of an interval management selection sequence exemplary of one embodiment of the inventive concepts disclosed herein.
Figure 4C:
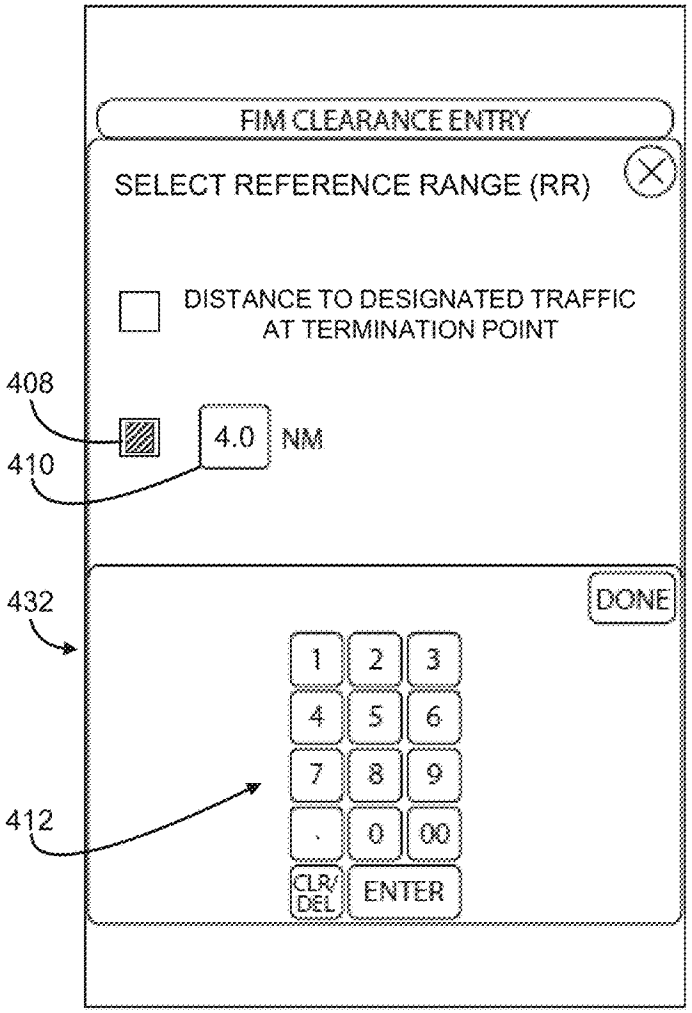
Figure 4B:
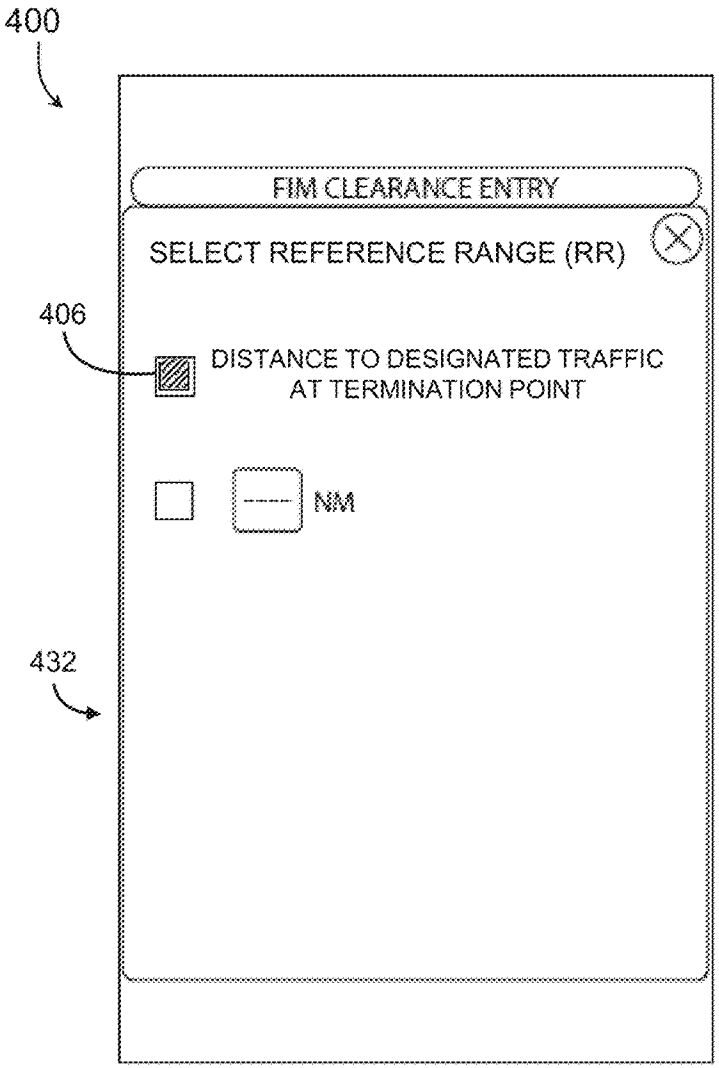

FIG. 4A-4C Sequence

Referring now to FIGS. 4A-4C, diagrams of an interval management selection sequence 400 exemplary of one embodiment of the inventive concepts disclosed herein are shown. To select the auto transition to visual separation, the pilot may select an auto transition selection 402 and an auto transition setup 404 on the IMD 132 which may direct the IMD 132 to a RR (e.g., a range alert) selection page 432 for further pilot input. It may be desirable for the aircrew to be consciously aware of the desire to perform the automatic transition, therefore one default state of the auto transition selection 402 may be disabled (un-selected).

To select a distance at which a range alert may be available to the pilot, the pilot may choose a select distance 406 at TP 334 in which a reference range for visual separation (RR) 410 may be set at the range between the two aircraft when the ownship aircraft 120 crosses the TP 334 (or planned termination point). Alternatively, should the pilot desire a specific range at which to set the RR 410, the pilot may select a custom distance selection 408 and type in the desired RR 410 in nautical miles (NM) using a keypad 412.

FIGS. 5A-5D IMD Sequence

Figure 5B:
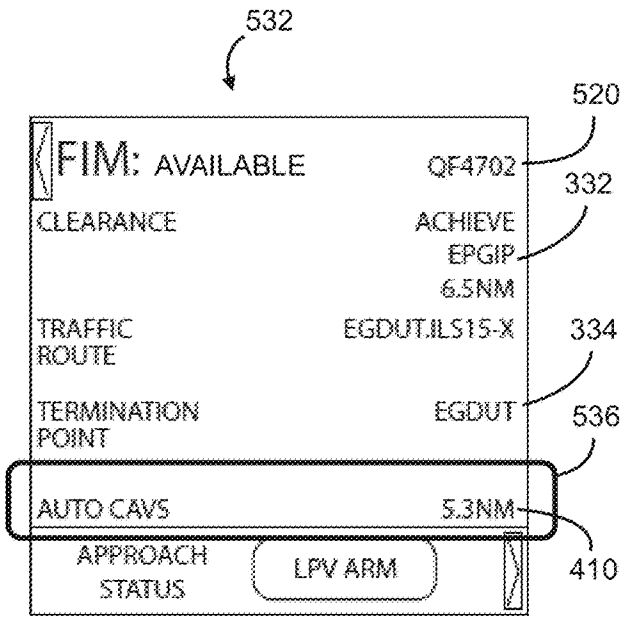
FIGS. 5A-5D are diagrams of an interval management display sequence in accordance with one embodiment of the inventive concepts disclosed herein.
Figure 5A:
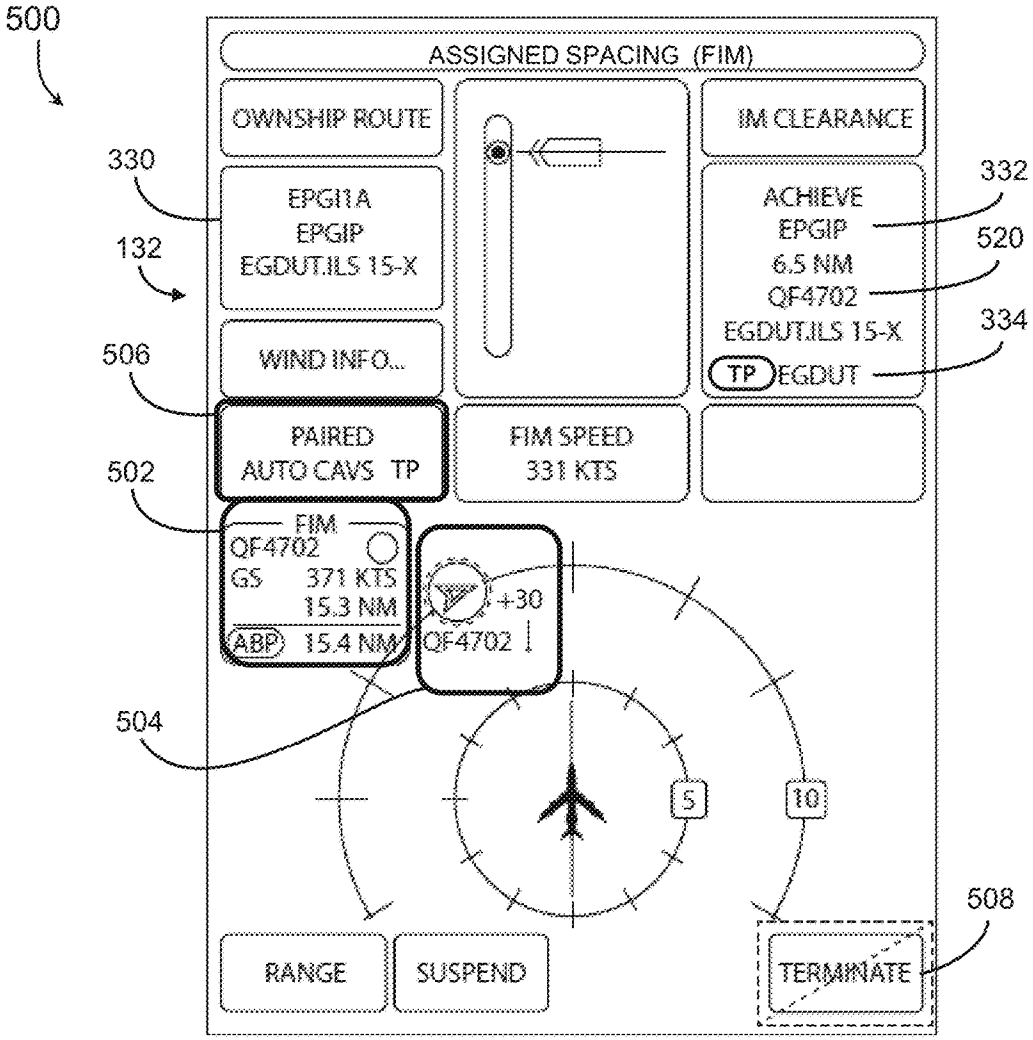

Referring now to FIGS. 5A-5D, a series of diagrams of an abbreviated interval management display sequence 500 in accordance with one embodiment of the inventive concepts disclosed herein are shown. FIG. 5A may indicate the IMD 132 once the assigned spacing application is functional with the controller 110 displaying the assigned spacing data block 502 and an assigned spacing symbology 504. In one embodiment, the controller 110 may also display an auto transition armed message 506 to indicate to the pilot the auto transition is armed as well as a terminate option for the pilot to select if necessary.

Once the assigned spacing application 220 is set up and functional, the controller 110 may display a plurality of information to the pilot on the IMD 132. In one embodiment of the inventive concepts disclosed herein, the controller 110 may display the assigned spacing data block 502 including the target aircraft callsign 520. In one embodiment, the assigned spacing data block 502 may include an ownship assigned airspeed, the identification of the target aircraft 320, a groundspeed of the target aircraft 320, a range to the target aircraft 320, a range to the ABP 332, and the TP 334.

In one embodiment, the t symbology 504 may include a target aircraft symbol with a relative vector of the target aircraft 320, a relative position of the target aircraft, a highlighted circle around the target aircraft, the identification of the target aircraft, a relative altitude of the target aircraft, and an altitude trend arrow of the target aircraft.

FIG. 5B may indicate an alternate interval management page 532 the system for aircraft auto transition from assigned spacing to visual separation 100 may employ when using the tablet or temporary display 140. With similar information presented as the IMD 132, the alternate interval management page 532 may also include an alternate auto transition armed message 536 as well as the selected RR 410.

Figures 5C, 5D:
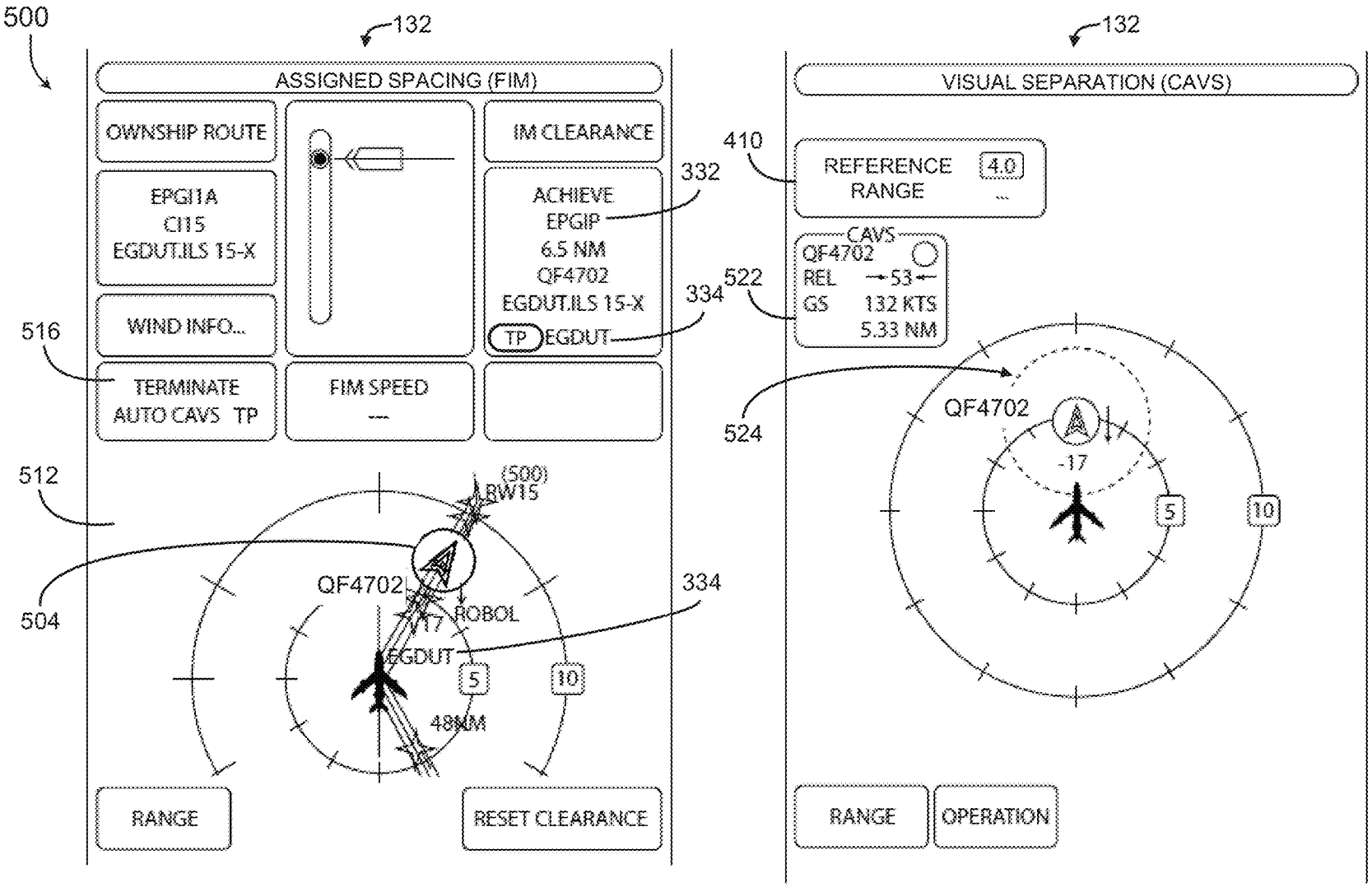

FIG. 5C may indicate the point at which the ownship aircraft 120 crosses the TP 334 of EGDUT and the controller 110 transitions from the assigned spacing application 220 to the visual separation application 224. Here, the controller 110 may remove the assigned spacing data block 512 and display and flash an auto transition complete message 516.

Once the transition to the visual separation application 224 is complete, the controller 110 may display a visual separation data block 522 and a visual separation symbology 524 to indicate to the pilot the completed transition. In one embodiment, the visual separation data block may include the identification of the target aircraft, a closure velocity between the ownship aircraft 120 and the target aircraft 320, the groundspeed of the target aircraft 320, the range to the target aircraft 320, and the RR 410. In one embodiment, the visual separation symbology may include the relative vector of the target aircraft, the relative position of the target aircraft, the highlighted circle around the target aircraft, the identification of the target aircraft, the relative altitude of the target aircraft, the altitude trend arrow of the target aircraft, and an outlined circle around the target aircraft representative of the RR.

System Function

In one embodiment of the inventive concepts disclosed herein, the controller 110 may operate to carry out each function of the system for aircraft auto transition from assigned spacing to visual separation 100. In one embodiment, the controller 110 may receive, via the communication system 114, the position, the altitude, the identification, and the velocity of a plurality of the target aircraft 320 and receive an interval clearance assigning the target aircraft 320 as an interval for the ownship aircraft, the interval clearance 214 including the TP 334 and the ABP 332. The controller 110 may display the assigned spacing data block 502 and the assigned spacing symbology 504 on each of the IMD 132 and the ND 134.

In one embodiment, the controller 110 may display an interval status message via a PFD mnemonic 534 on the PFD 136, the PFD mnemonic 534 (FIG. 6J) may include a mnemonic of either the assigned spacing application 220 (e.g., FIM) or the visual separation application 224 (e.g., CAVS). The controller 110 may display, on the IMD 132, an auto transition selection 402 for the user selection of an auto transition from the assigned spacing application 220 to the visual separation application 224.

Once the pilot may select the auto option in the auto transition selection 402 and select the auto transition setup option 404, the controller 110 may receive the user selection of the auto transition and display, on the IMD 132, a range option for the user selection of the RR 410 between the ownship aircraft 120 and the target aircraft 320, the RR 410 being one of: a distance to the target aircraft at the TP with the selection 406 and a user selectable range to the target aircraft with custom distance selection 408. Once selected, the controller 110 may receive the user selection of the RR 410 and display an auto transition armed message 506 on the IMD 132, the auto transition armed message 506 including each of: 1) a paired message, 2) an auto message, and 3) the RR 410 (either TP or the selected number).

In one embodiment, the controller 110 may function to display an execute option on the IMD 132 and receive a user selection of the execute option. Also, the controller 110 may display a suspend option for user selection to discontinue the auto transition.

In one embodiment, the navigation system 116 may indicate the ownship aircraft 120 has reached the TP 334 where the controller 110 may automatically transition from the assigned spacing application 220 to the visual separation application 224 without the user interaction. In this manner, the controller 110 may seamlessly transition to the visual separation application with no user input or action. Here, the transition may include a data handover 222 from the assigned spacing application 220 to the visual separation application 224. In one embodiment, the data handover 222 may include a plurality of data associated with the target aircraft 320 including the position, the altitude, the RR, the identification, and the velocity of the target aircraft 320.

In one embodiment, the controller 110 may hold the assigned spacing application 220 in the terminated state for 3 seconds, then the controller 110 may transfer the designated traffic ID and desired RR to the visual separation application 224, activate the visual separation application 224, and self-terminate completing the automatic transition to the visual separation application 224. Also, the controller 110 may function to intermittently flash the auto transition armed message 506 and the RR 410 at the auto transition. Also, in the transition between the assigned spacing symbology 504 and the visual separation symbology 524, the controller 110 may command an intermittent discontinuance (e.g., multiple flash off then on) of one or more portions of the target aircraft symbology.

The controller 110 may then discontinue the display of the assigned spacing data block 502 and the assigned spacing symbology 504 on each of the IMD 132 and the ND 132 and display an auto transition complete message 516 on the cockpit display. With the auto transition complete, the controller 110 may display the visual separation data block 522 and the visual separation symbology 524 on each of the IMD 132 and the ND 134 and display the mnemonic 534 of the visual separation application on the PFD 136.

In one embodiment, the controller 110 may function to command the following exemplary delay steps to successfully accomplish the transition from the assigned spacing application 220 to the visual separation application 224: the controller 110 may hold the assigned spacing application 220 terminate state for three seconds, the assigned spacing application 220 may set an automatic transition flag to TRUE, the controller 110 may set a RR 410 variable to a current range-to-designated traffic, OR the desired RR value entered by the crew in the RR 410 selection screen, the controller 110 may launch the visual separation application 224 with the same designated traffic specified in the interval clearance, the controller may reset the interval clearance and close the assigned spacing application 220.

The controller 110 may set an auto transition flag and, if TRUE, will set the RR value to the value communicated by the data handover 222, suppress initial RR selection prompts, and suppress a RR advisory for approximately eight seconds

FIG. 6A-6R

Figure 6A:
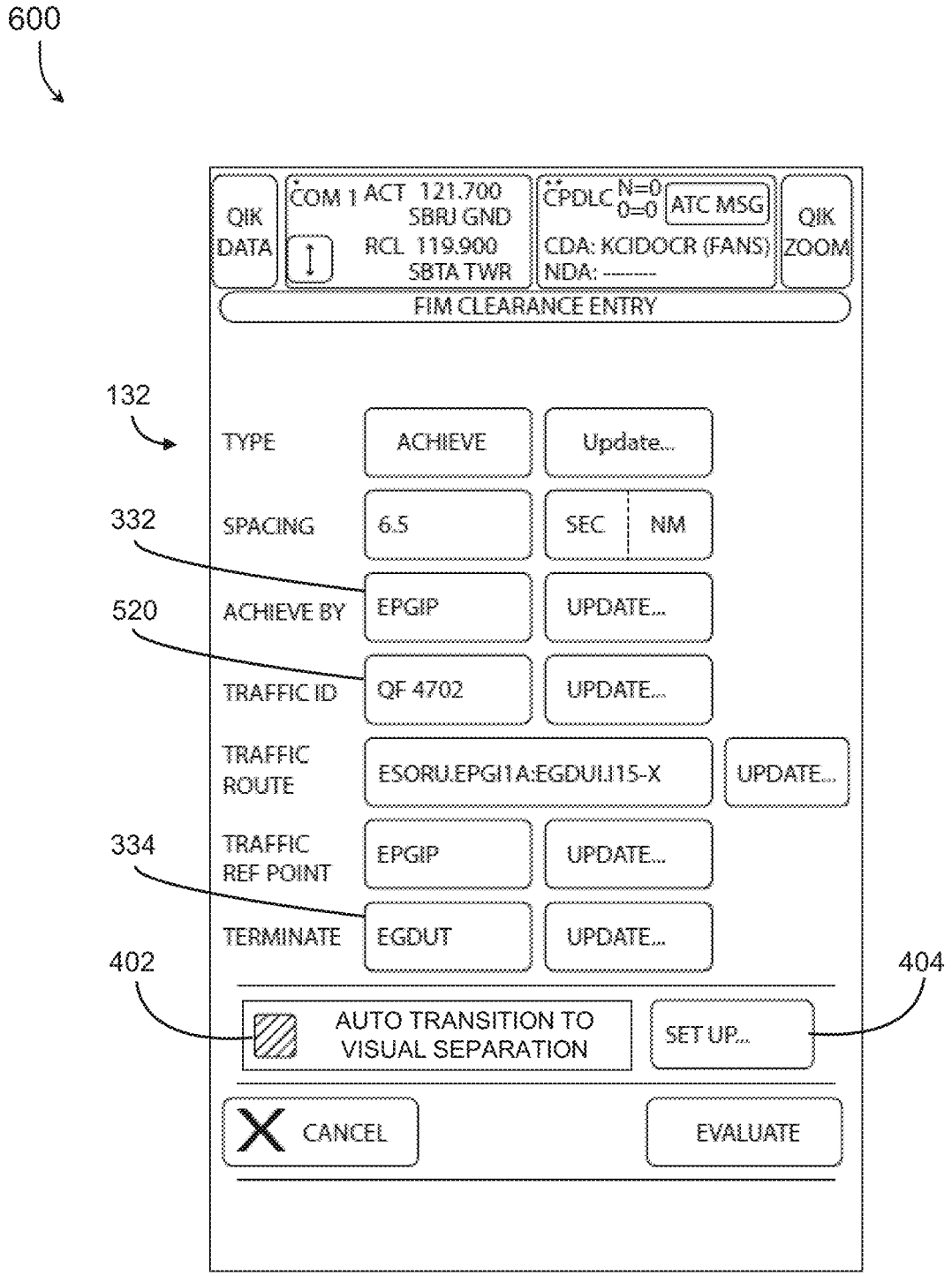
FIGS. 6A-6R are diagrams of an exemplary arrival sequence in accordance with one embodiment of the inventive concepts disclosed herein.
Figure 6B:
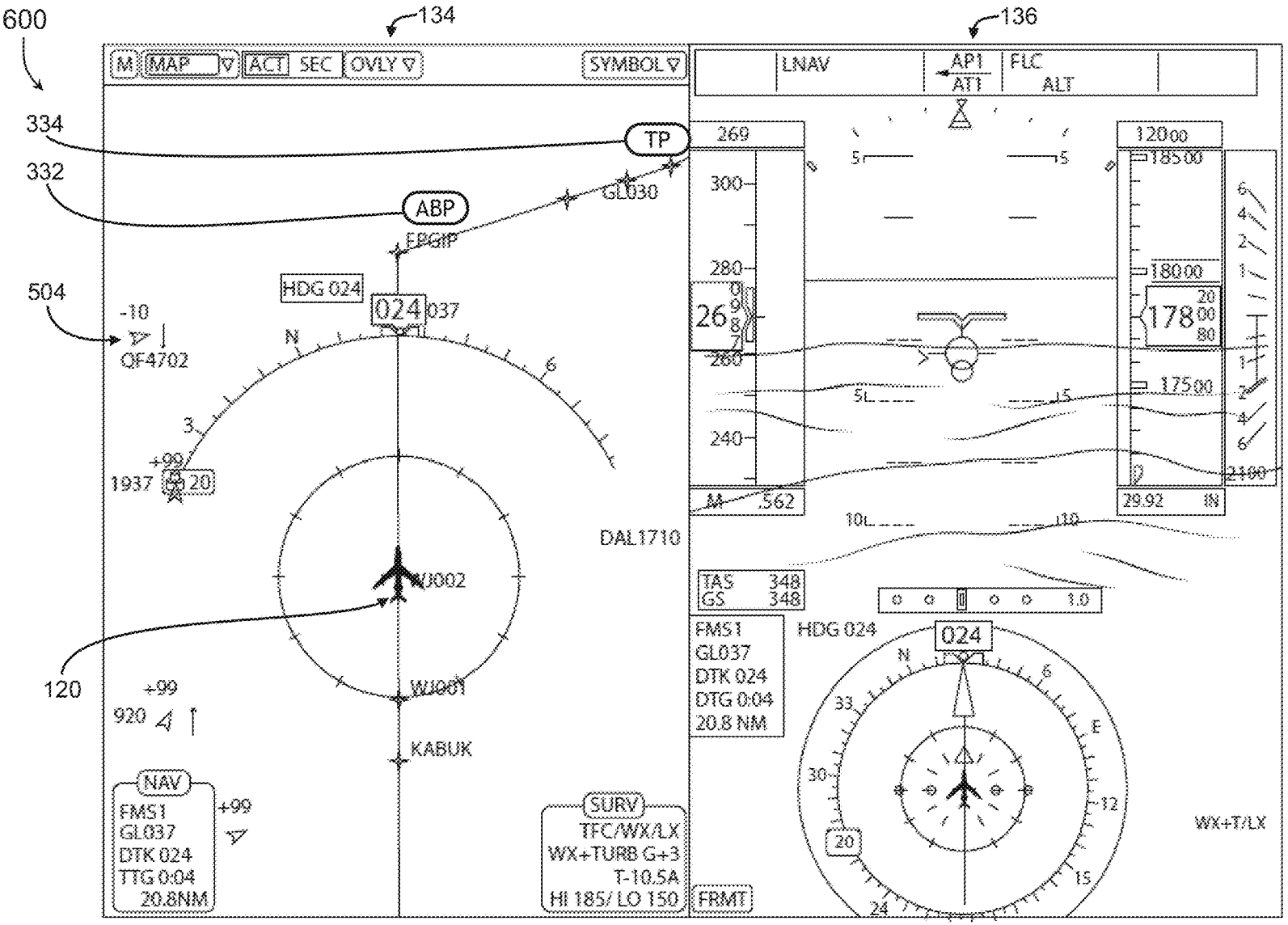
Figure 6C:
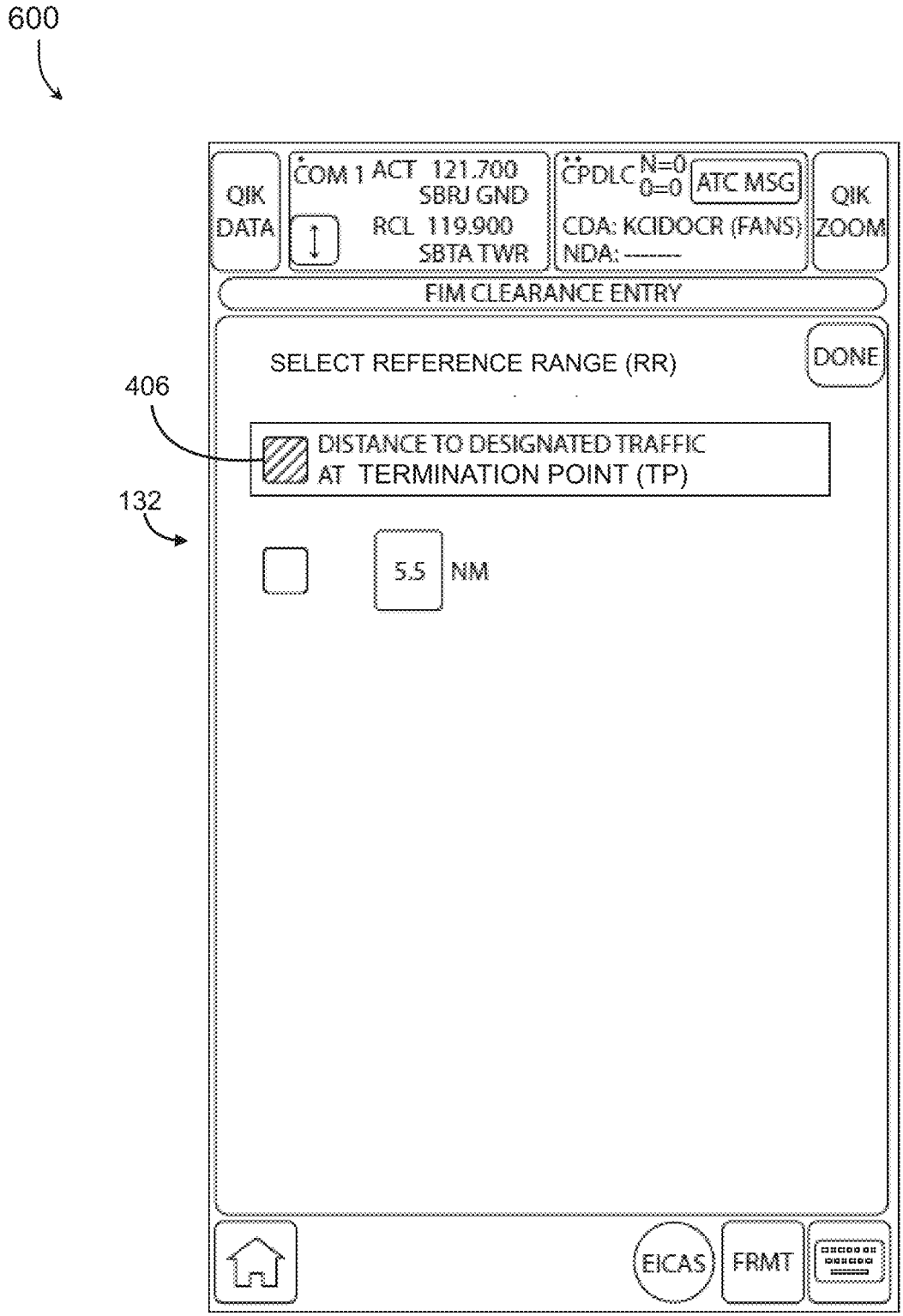
Figure 6D:
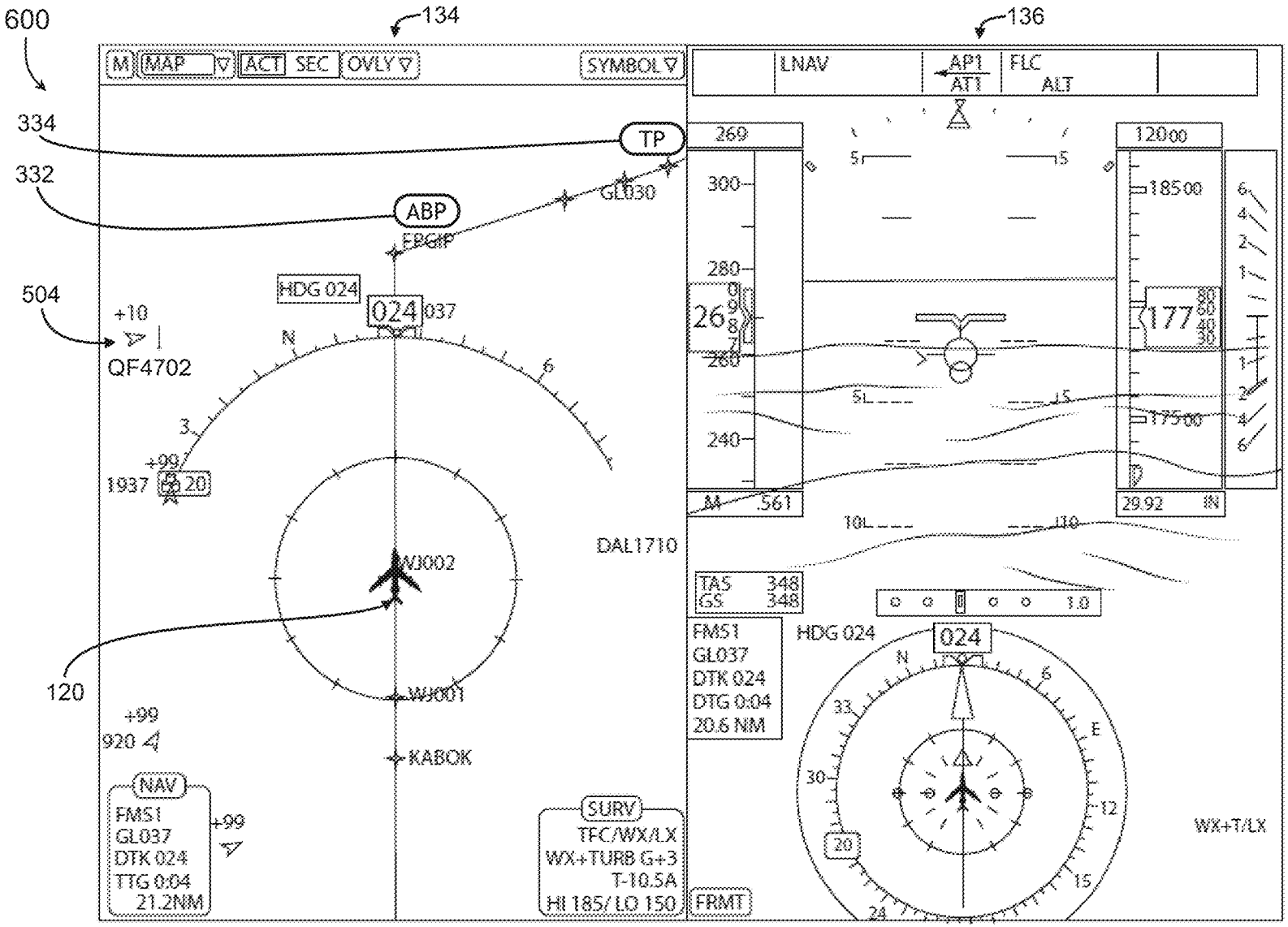
Figure 6E:
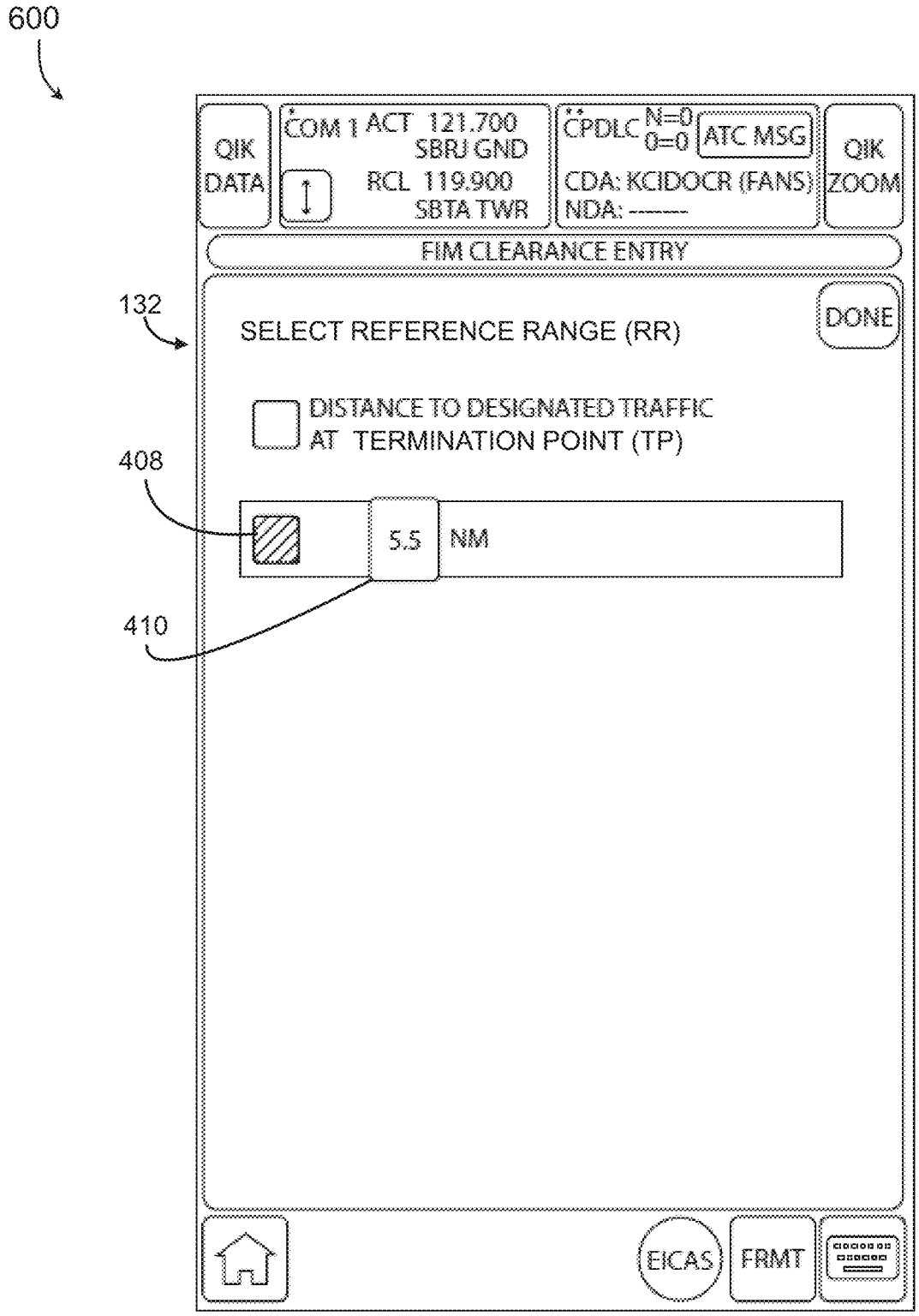
Figure 6F:
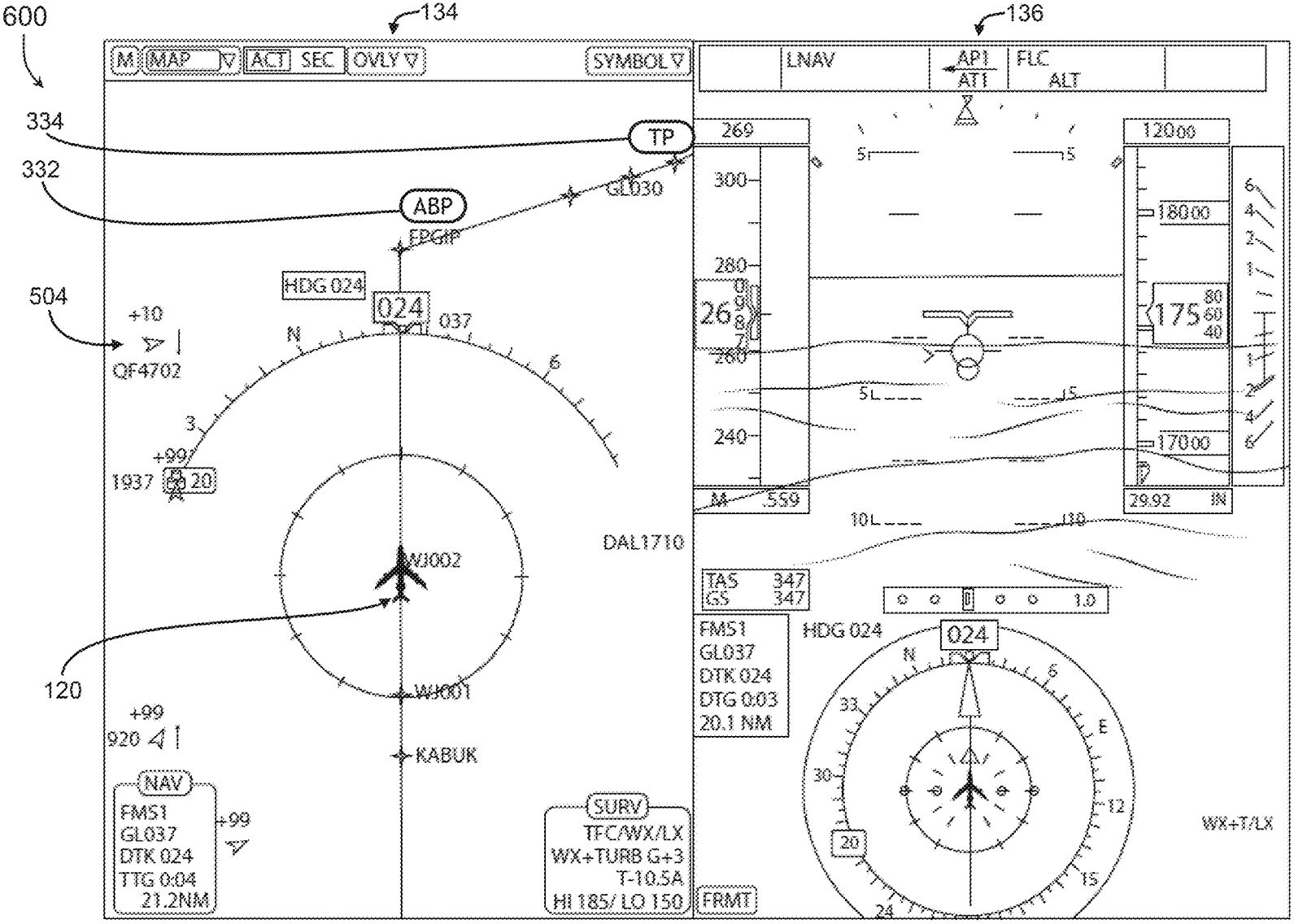
Figure 6G:
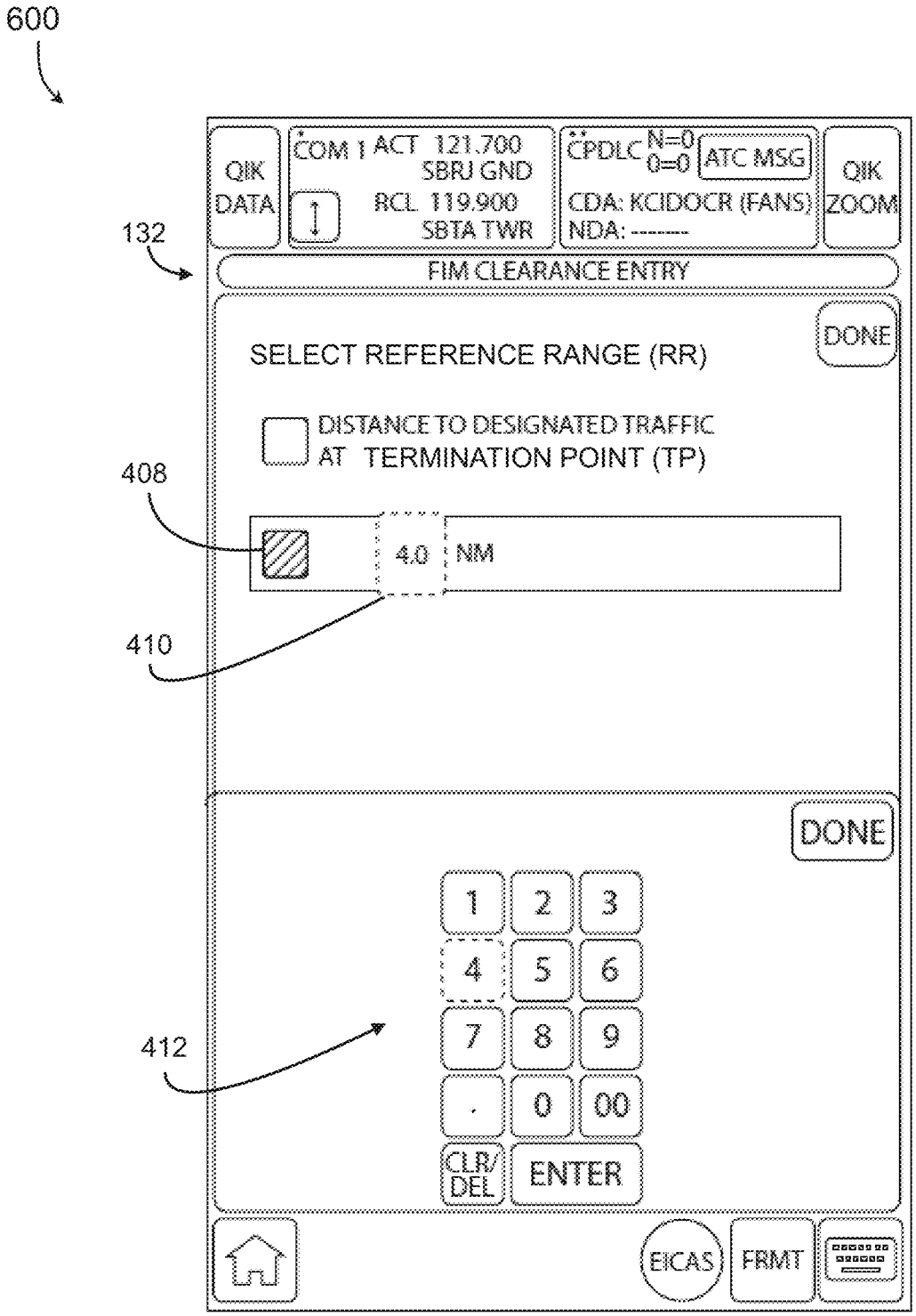
Figure 6H:
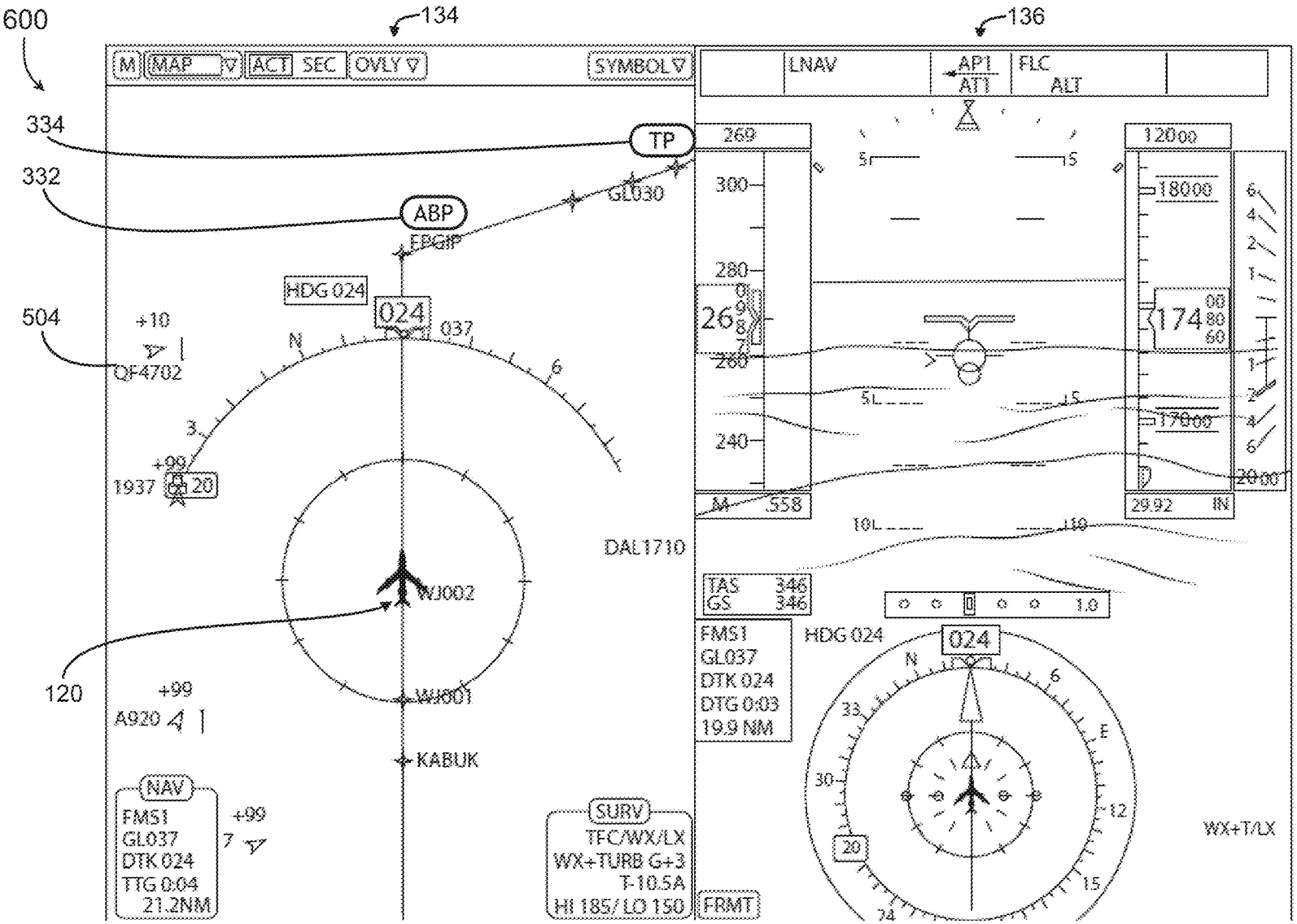
Figure 6I:
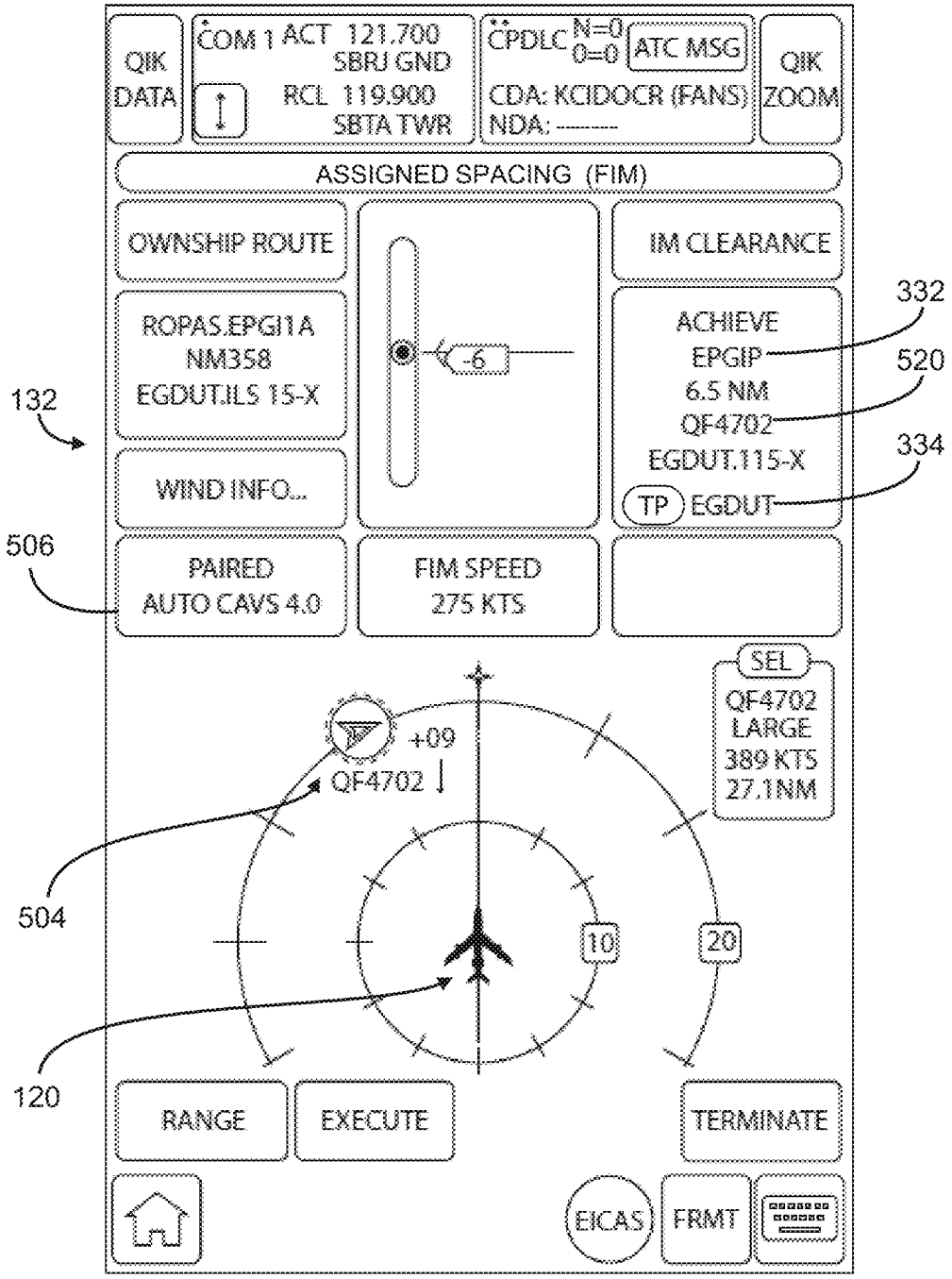
Figure 6J:
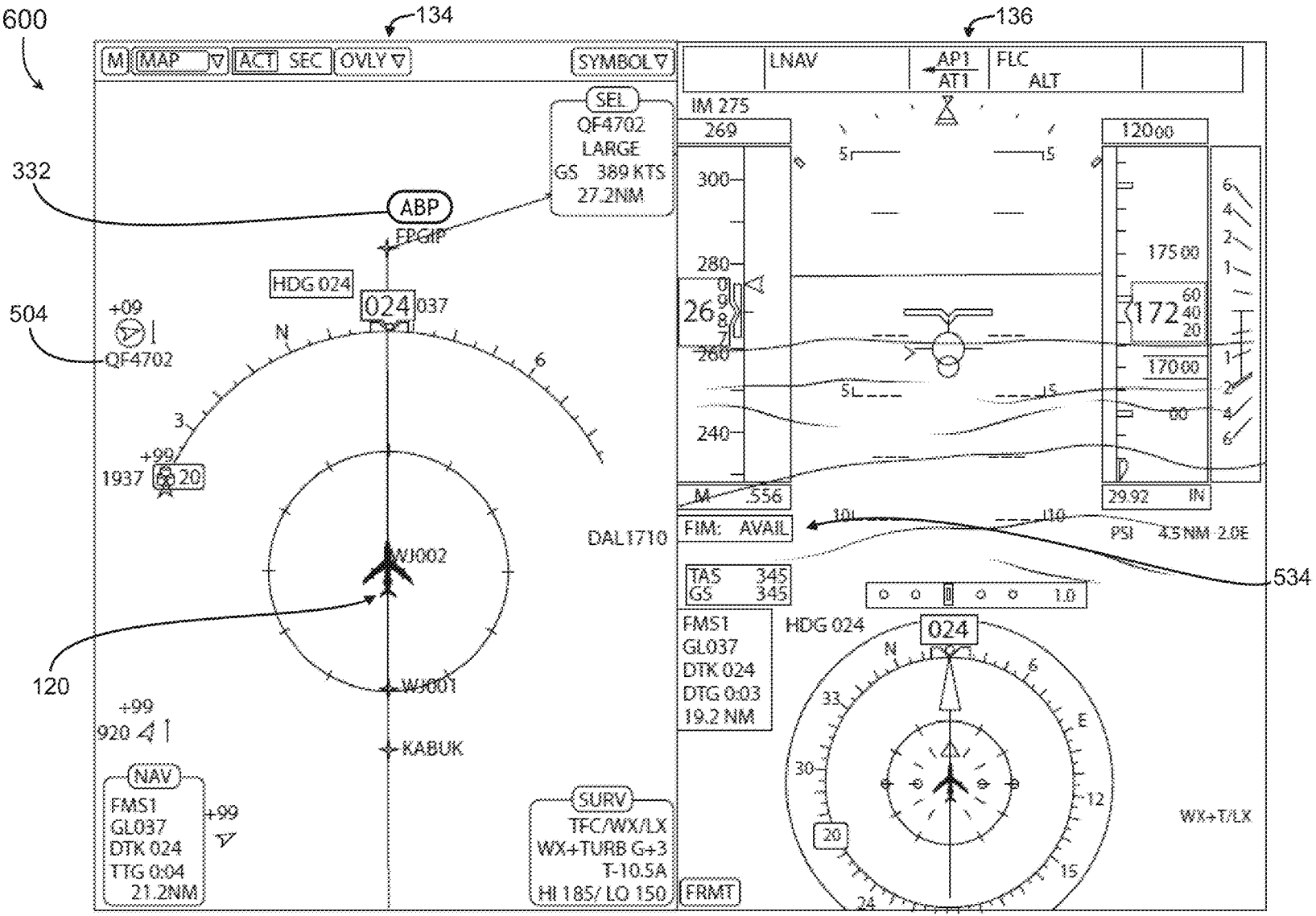
Figure 6K:
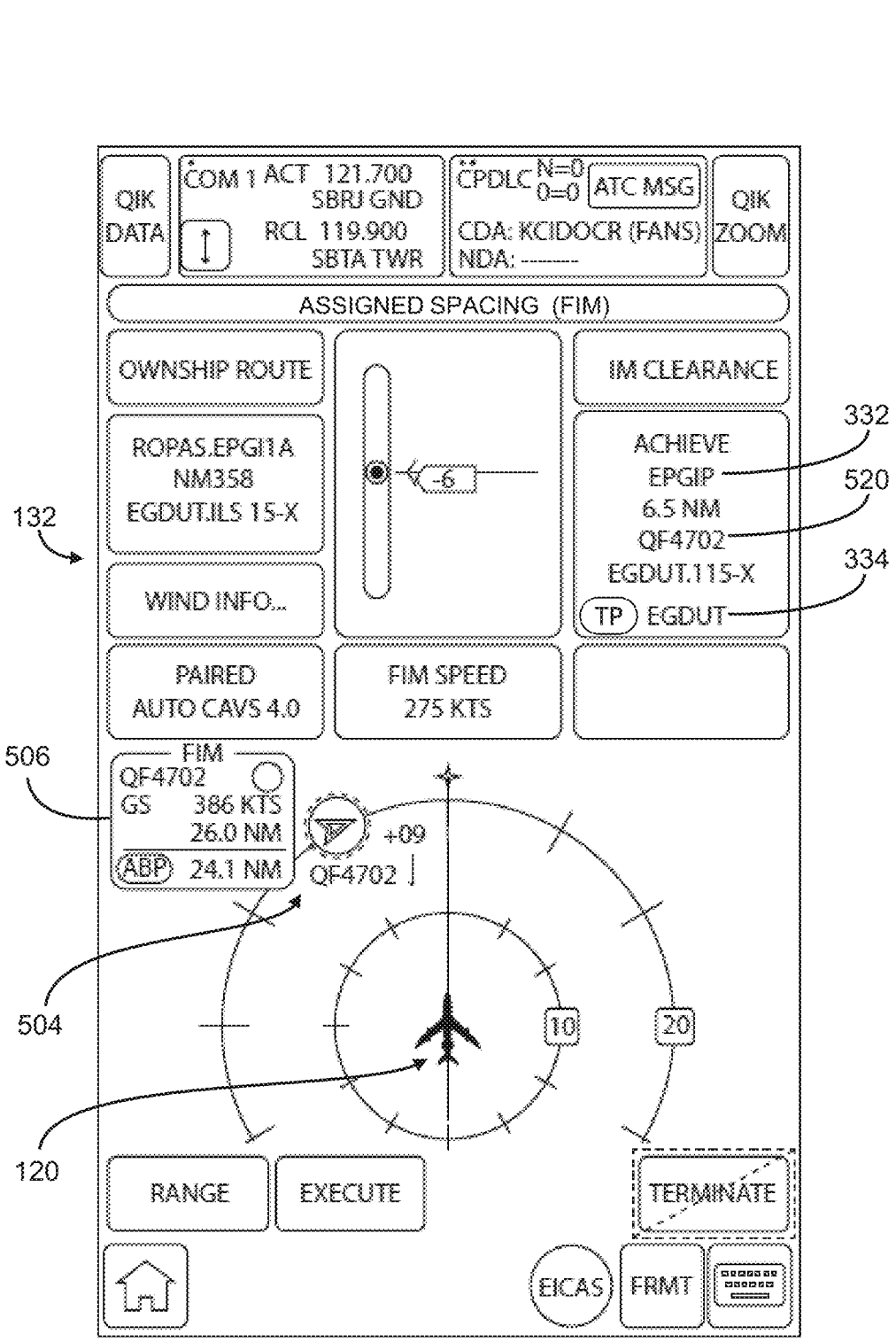
Figure 6L:
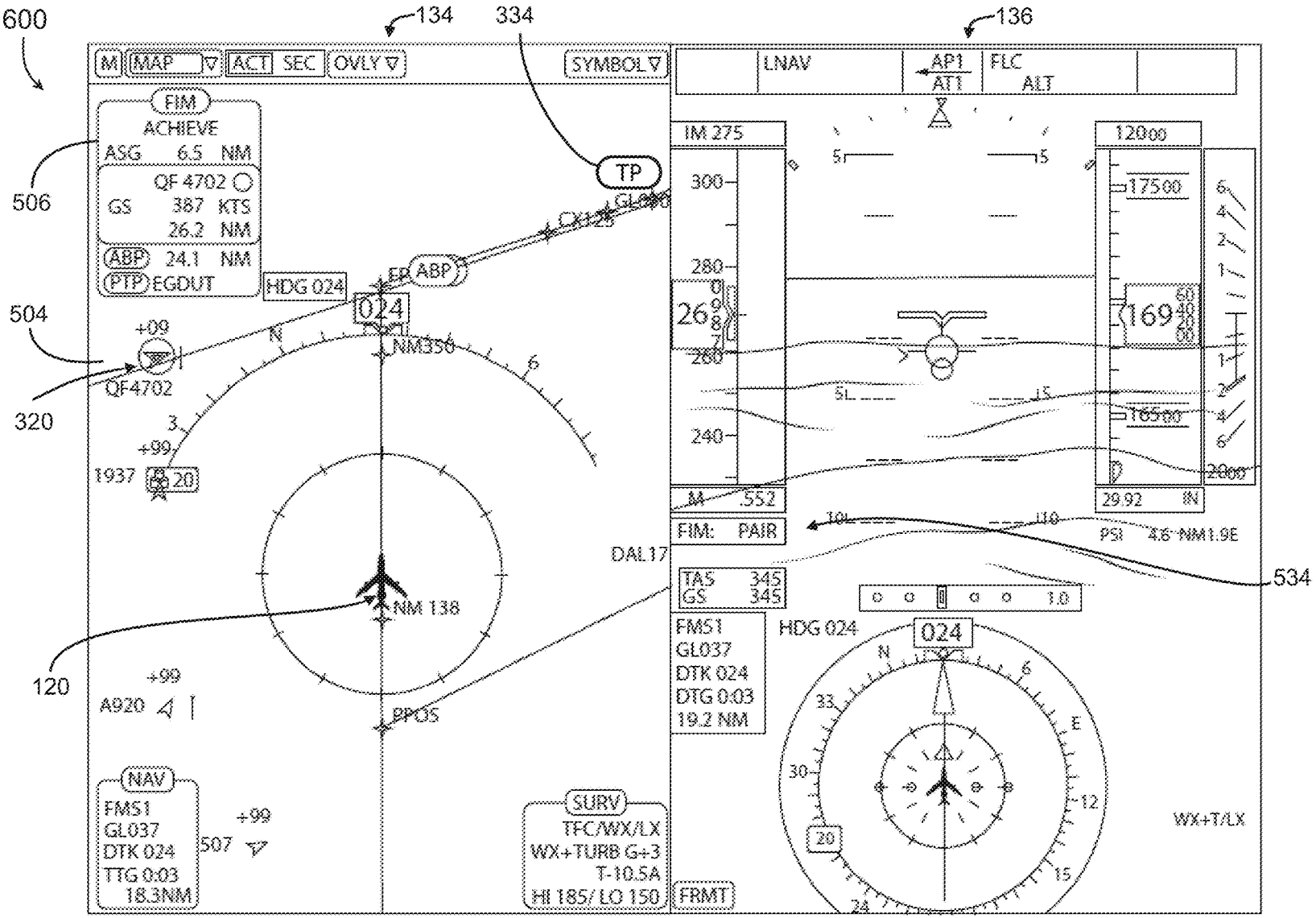
Figure 6M:
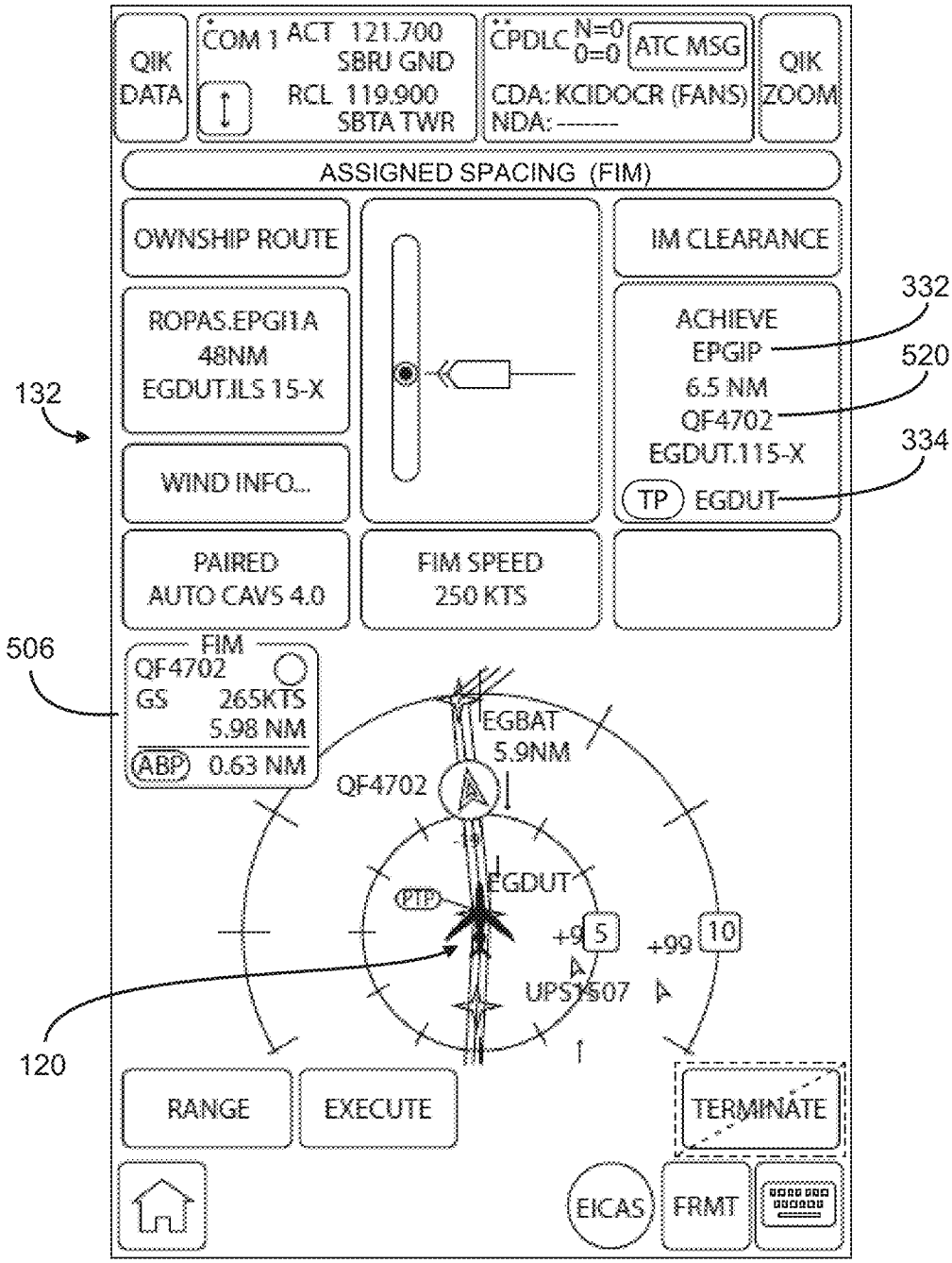
Figure 6N:
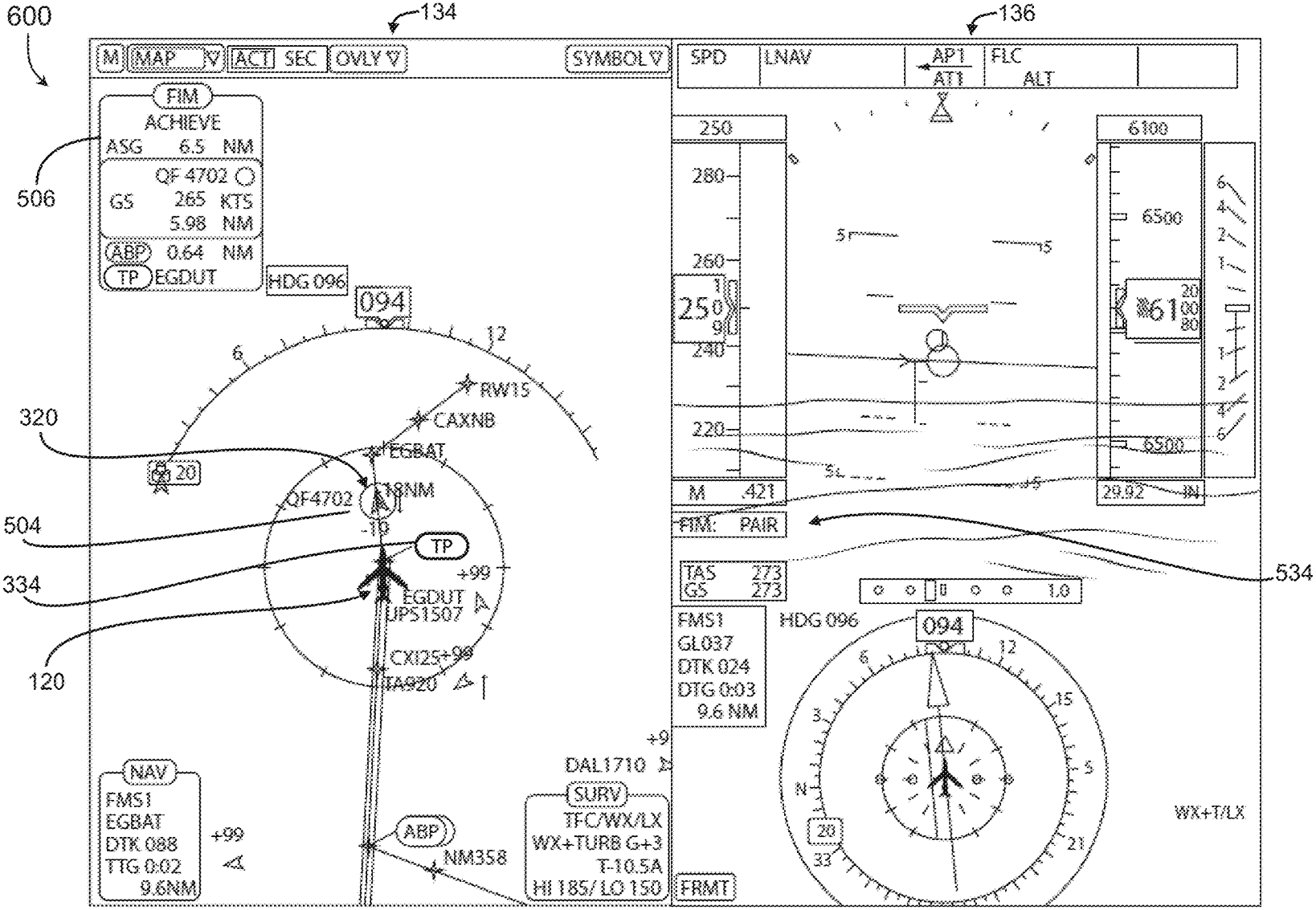
Figure 6O:
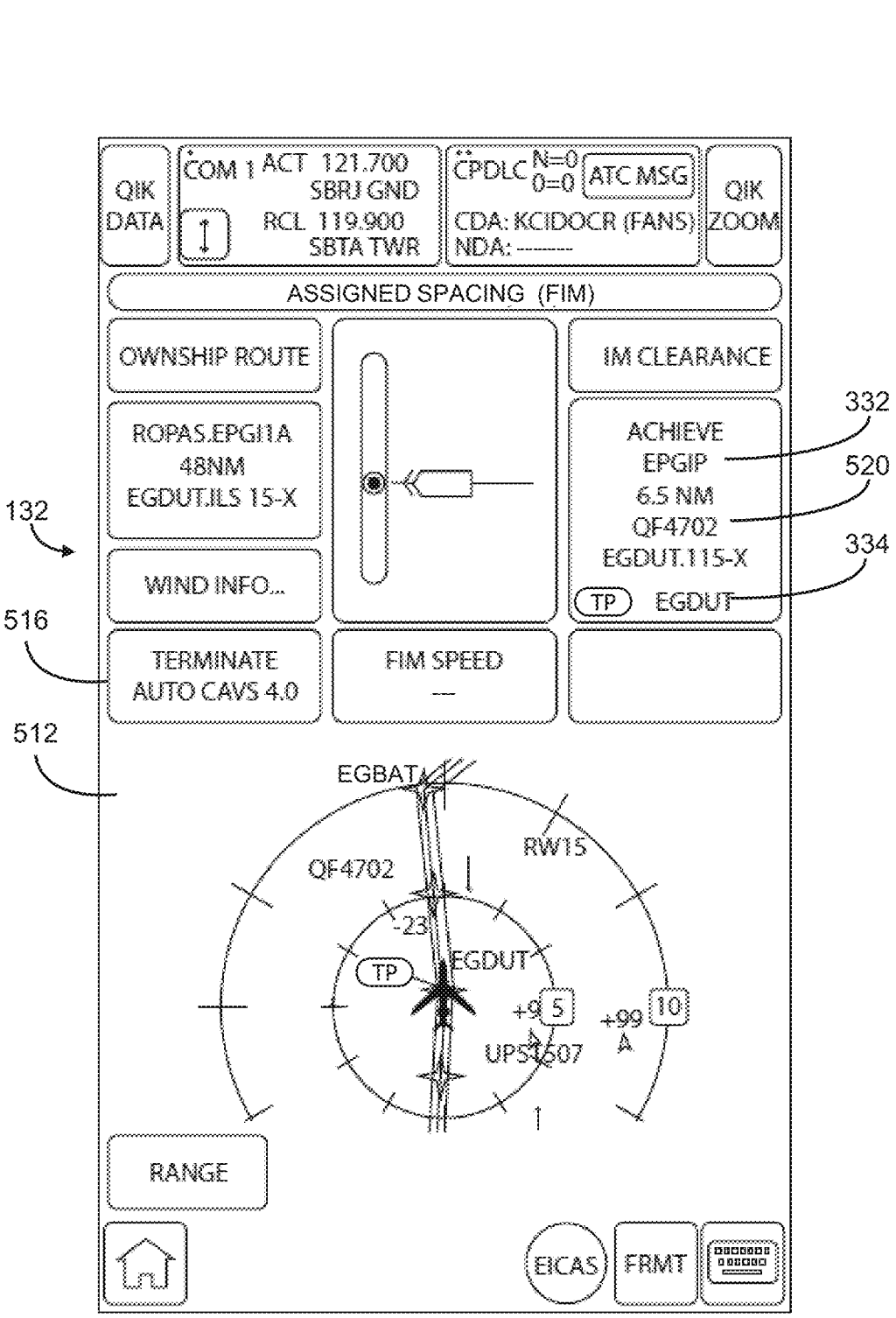
Figure 6P:
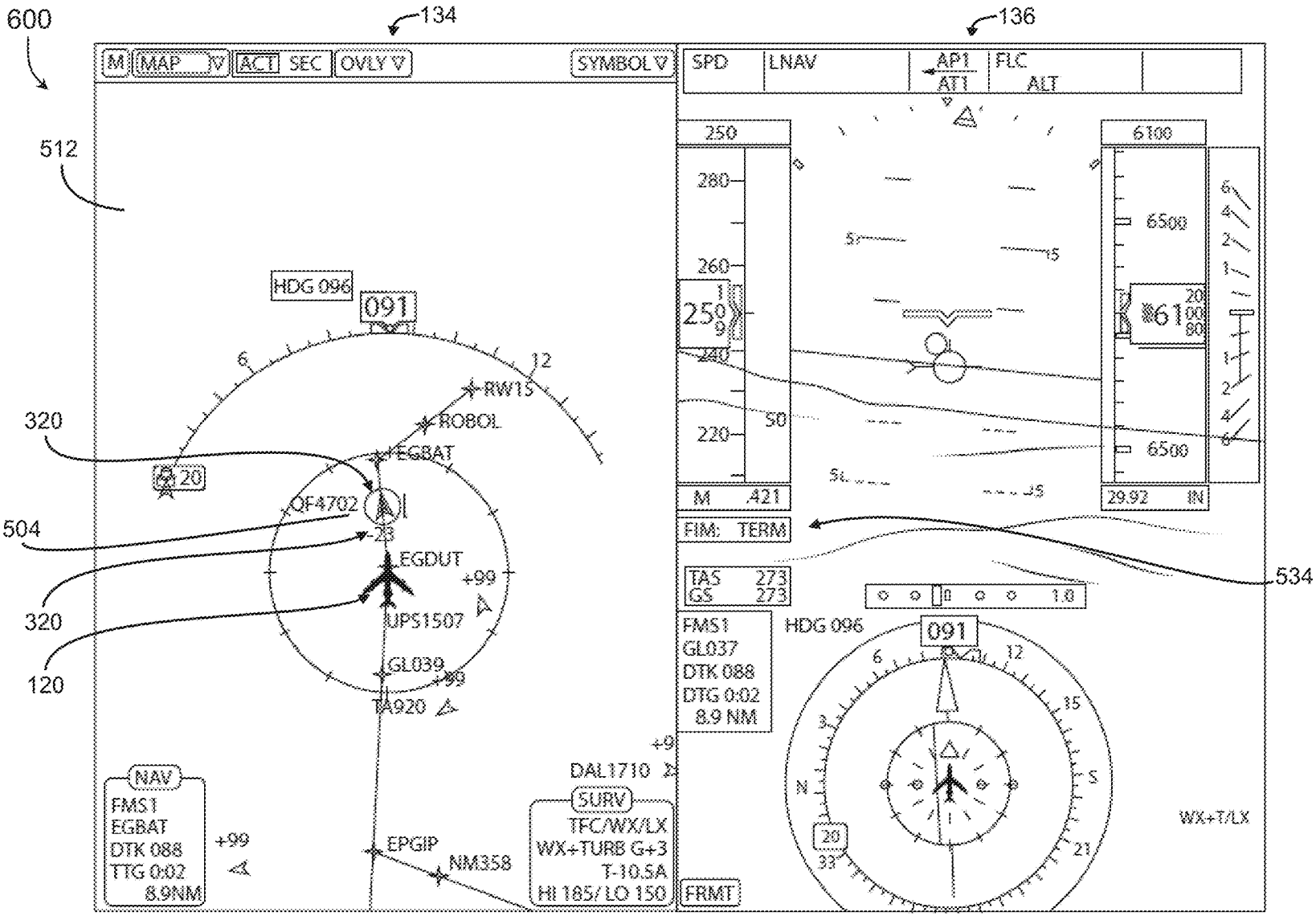
Figure 6Q:
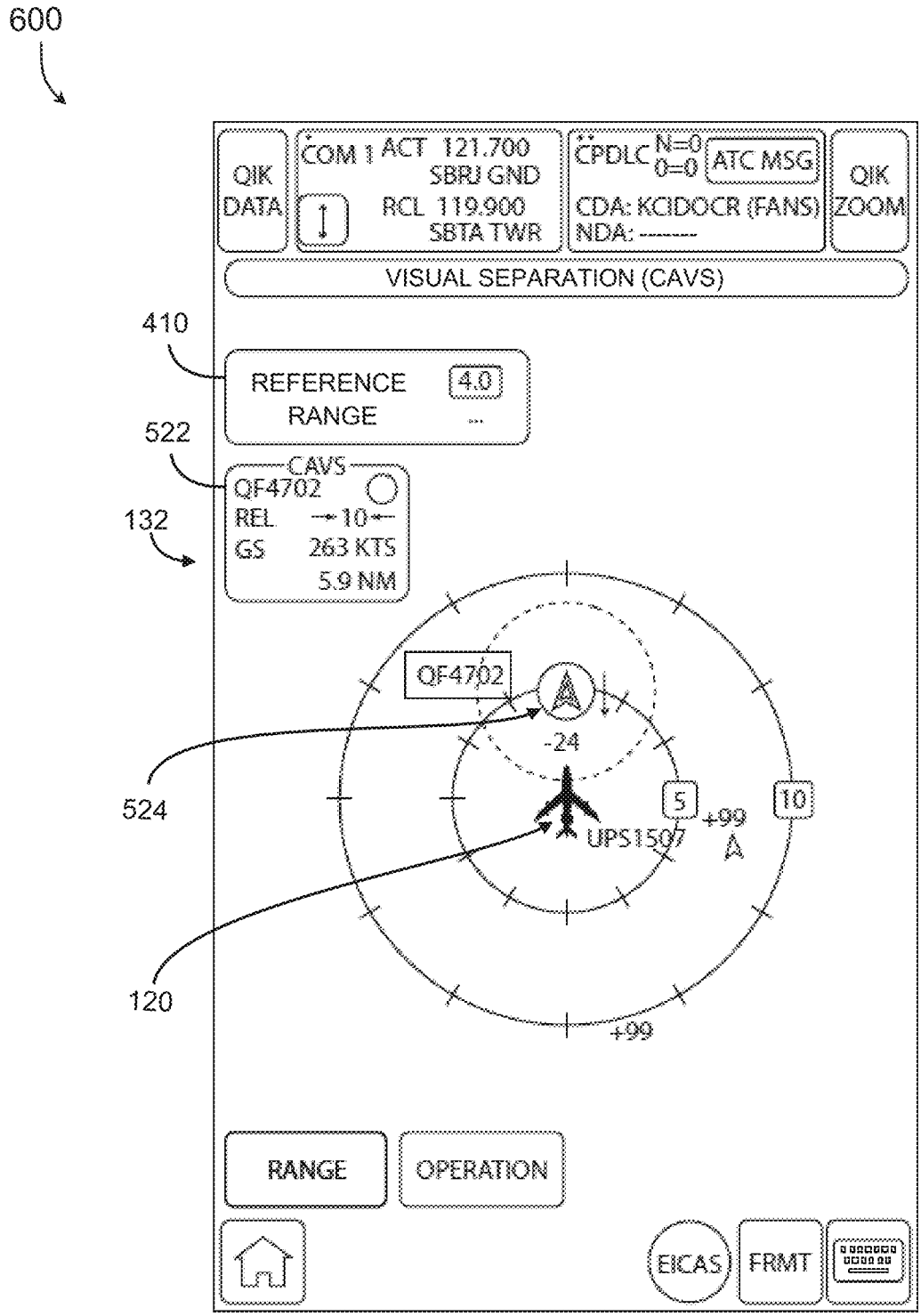
Figure 6R:
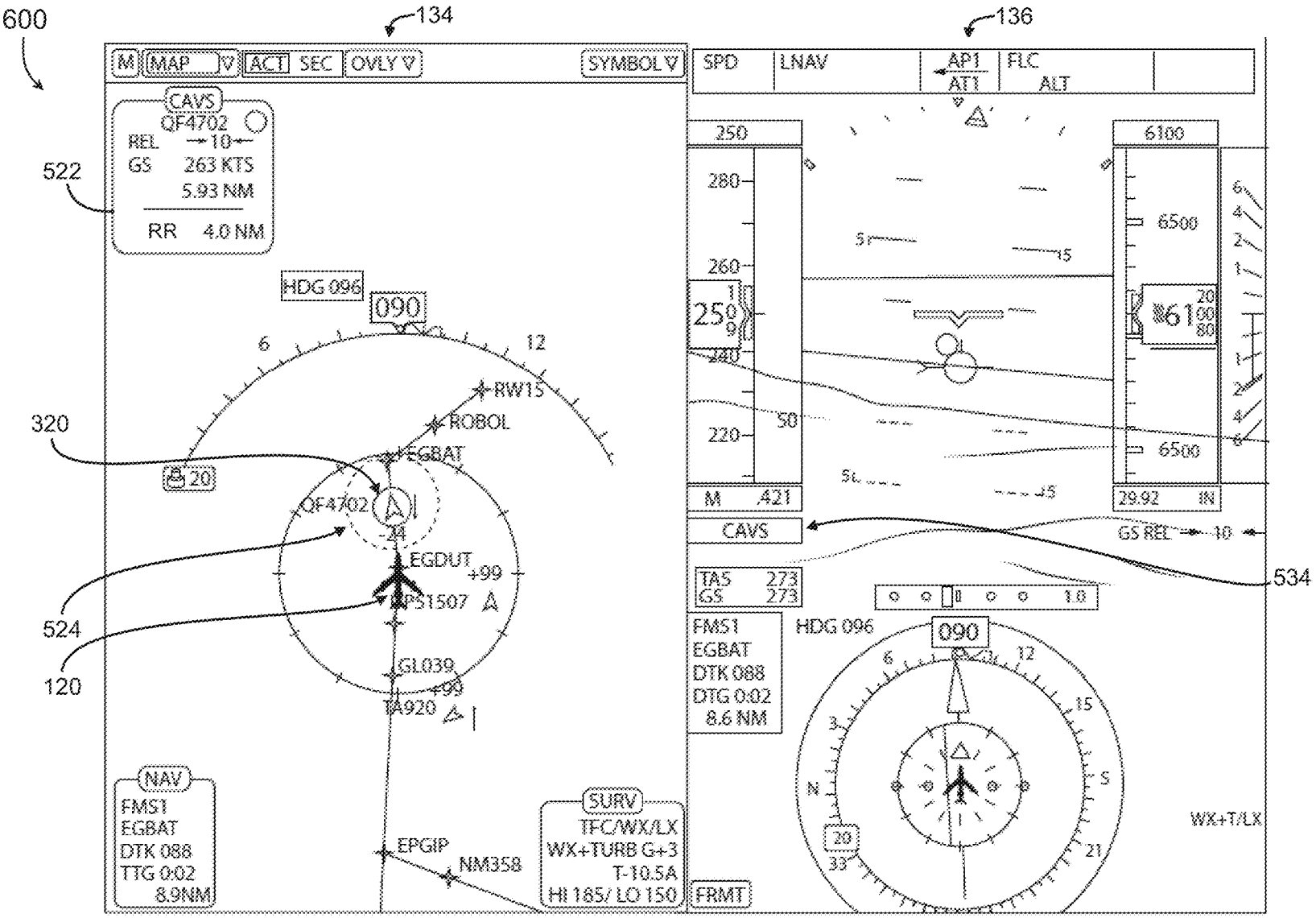

Referring now to FIGS. 6A-6R, diagrams of an exemplary arrival sequence 600 in accordance with one embodiment of the inventive concepts disclosed herein are shown. The arrival sequence 600 may include an exemplary scenario from waypoint KABUK south of the destination SBGL 336 to the TP 334 of EGDUT. The interaction between the controller 110 and each of the cockpit display 130 elements may offer the pilot situational awareness of the assigned spacing as well as the seamless transitions between the assigned spacing application 220 and the visual separation application 224. Here, each pair of slides may indicate a specific snapshot in time between KABUK and EGDUT where:

FIGS. 6A and 6B—27.7 NM south of EPGIP—initial set up of the auto transition;

FIGS. 6C and 6D—27.7 NM south of EPGIP—initial set up RR selection of TP range;

FIGS. 6E and 6F—27.7 NM south of EPGIP—initial set up RR custom selection;

FIGS. 6G and 6H—27.7 NM south of EPGIP—initial set up RR custom selection of custom value of 4.0;

FIGS. 6I and 6J—27.7 NM south of EPGIP—Auto transition is armed, assigned spacing application is active. The controller 110 has begun to display a PFD mnemonic 534 indicating which application is active (here, FIM: AVAIL);

FIGS. 6K and 6L—24.1 NM south of EPGIP—The pilot has executed the assigned spacing application 220 and the controller 110 has begun to display the assigned spacing data block 502 on each of the IMD 132 and the ND 134 as well as the PFD mnemonic 534 on the PFD 136 indicating FIM: PAIR;

FIGS. 6M and 6N—0.63 NM west of EGDUT—the controller 110 continues to display the assigned spacing data block 502 and the assigned spacing symbology, however, the ownship aircraft has turned right to maintain the track inbound;

FIGS. 6O and 6P—at EGDUT waypoint—the controller 110 has auto terminated the assigned spacing application 220 and removed the assigned spacing data block 512, however, the assigned spacing symbology remains displayed since pilot awareness of the target aircraft 320 is maintained;

FIGS. 6Q and 6R—8.9 NM west of EGBAT—the controller 110 has completed the auto transition from the assigned spacing application 220 to the visual separation application 224 indicated by the visual separation data block 522, the visual separation symbology 524, and the PFD abbreviated mnemonic 534 on the PFD 136 indicating the visual separation application (CAVS).

In one embodiment, in display of the PFD mnemonic 534 on the PFD 136, the controller 110 may indicate each phase of the system for aircraft auto transition from assigned spacing to visual separation 100 to the pilot. Some exemplary PFD mnemonic 534 may include a FIM: AVAIL (FIG. 6J) indicating the FIM mode is available for execution, a FIM: PAIR (FIG. 6L) indicating the assigned spacing application 220 (here, FIM) has been executed and the assigned interval is the target aircraft 320, a FIM: TERM (FIG. 6P) indicating the auto transition is taking place and the assigned spacing application (FIM) has terminated, and a CAVS (FIG. 6R) indicating the auto transition has taken place and the visual separation application 224 (CAVS) is active.

FIG. 7 Method

Figure 7:
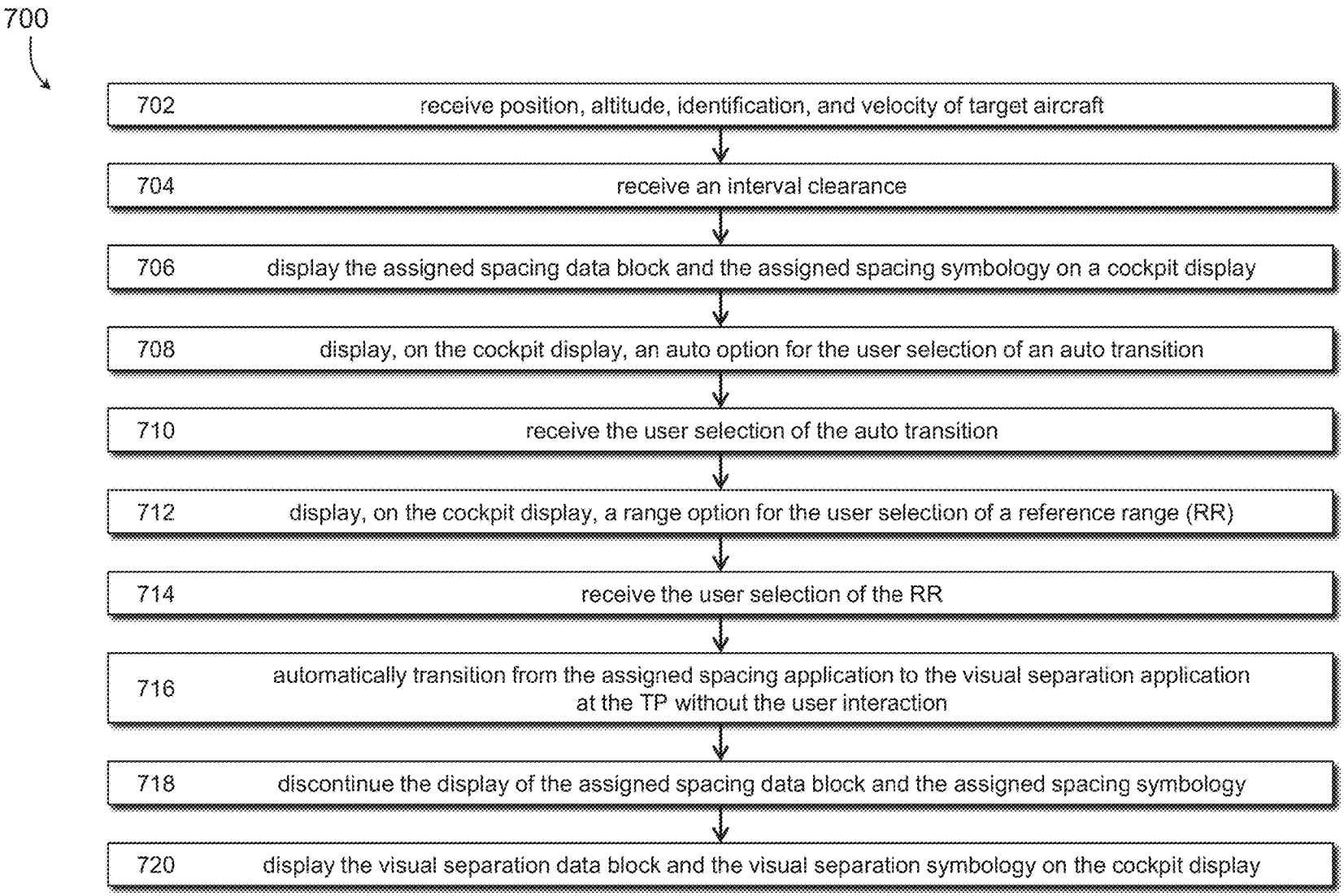
FIG. 7 is a diagram of a method flow associated with one embodiment of the inventive concepts disclosed herein.

Referring now to FIG. 7, a diagram of a method flow associated with one embodiment of the inventive concepts disclosed herein is shown. The method flow 700 may include, at a step 702 receiving, via a communication system onboard an ownship aircraft, a position, an altitude, an identification, and a velocity of a target aircraft, and at a step 704, receiving an interval clearance assigning the target aircraft as an interval for the ownship aircraft, the interval clearance associated with each of the assigned spacing application and the visual separation application, the interval clearance including a termination point (TP).

The method 700 may continue at a step 706 with displaying, on a cockpit display, an assigned spacing data block and an assigned spacing symbology, each associated with the assigned spacing application, and at a step 708 with displaying, on the cockpit display, an auto option for a user selection of an auto transition from the assigned spacing application to the visual separation application.

At a step 710, the method may function in receiving the user selection of the auto transition, and at a step 712, displaying, on the cockpit display, a range option for the user selection of a reference range for visual separation (RR) between the ownship aircraft and the target aircraft, the RR one of: a distance to the target aircraft at the TP and a user selectable range to the target aircraft. A step 714 may include receiving the user selection of the RR.

The method may continue at a step 716 with automatically transitioning from the assigned spacing application to the visual separation application at the TP without the user selection, the automatic transitioning including a data handover from the assigned spacing application to the visual separation application, the data handover including the position, the altitude, the identification, the RR, and the velocity of the target aircraft, and, at a step 718, discontinuing the display of the assigned spacing data block and the assigned spacing symbology on the cockpit display. The method may include, at a step 720, displaying, on the cockpit display, a visual separation data block and a visual separation symbology, each associated with the visual separation application.

CONCLUSION

As will be appreciated from the above description, embodiments of the inventive concepts disclosed herein may provide a novel solution to enable auto transition between an assigned separation cockpit application and a visual separation cockpit application.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. A system for aircraft auto transition from assigned spacing to visual separation, comprising:

a communication system onboard an ownship aircraft, the communication system configured at least for receiving a position, an altitude, an identification, and a velocity of a target aircraft;

a cockpit display onboard the ownship aircraft, the cockpit display configured for display of at least one of: 1) a primary flight display (PFD), 2) a navigation display (ND), 3) a user interface, 4) an interval management display (IMD) associated with an assigned spacing application, 5) an assigned spacing data block and an assigned spacing symbology associated with the assigned spacing application, and 6) a visual separation data block and a visual separation symbology associated with a visual separation application, the user interface further configured for a user interaction and a user selection;

a controller onboard the ownship aircraft, the controller operatively coupled with each of the communication system and the cockpit display;

a tangible, non-transitory memory configured to communicate with the controller, the tangible, non-transitory memory having instructions stored therein that, in response to execution by the controller, cause the controller to:

receive, via the communication system, the position, the altitude, the identification, and the velocity of at least one of the target aircraft;

receive an interval clearance assigning the target aircraft as an interval for the ownship aircraft, the interval clearance including a termination point (TP);

display the assigned spacing data block and the assigned spacing symbology on the cockpit display;

display an interval status message on the cockpit display, the interval status message including an indication of the assigned spacing application or the visual separation application;

display, on the cockpit display, an auto option for the user selection of an auto transition from the assigned spacing application to the visual separation application;

receive the user selection of the auto transition;

display, on the cockpit display, a range option for the user selection of a reference range for visual separation (RR) between the ownship aircraft and the target aircraft, the RR one of: a distance to the target aircraft at the TP and a user selectable range to the target aircraft;

receive the user selection of the RR;

in response to the user selection of the auto transition, automatically transition from the assigned spacing application to the visual separation application at the TP without the user interaction, the auto transition including a data handover from the assigned spacing application to the visual separation application, the data handover including the position, the altitude, the identification, and the velocity of the target aircraft and the RR;

discontinue the display of the assigned spacing data block and the assigned spacing symbology on the cockpit display;

in response to the user selection of the RR, display the visual separation data block and the visual separation symbology on the cockpit display; and in response to the user selection of the RR, display the indication of the visual separation application on the cockpit display.

2. The system for aircraft auto transition from assigned spacing to visual separation of claim 1, wherein the controller is configured to determine an arrival of the ownship aircraft at the TP based on one of: a calculation by the controller and an indication from an onboard navigation system.

3. The system for aircraft auto transition from assigned spacing to visual separation of claim 1, wherein the controller is further configured to display an auto transition armed message on the cockpit display, the auto transition armed message including each of: 1) a paired message, 2) an auto message, and 3) the RR.

4. The system for aircraft auto transition from assigned spacing to visual separation of claim 1, wherein the communication system is configured for transmission and reception of one of a data signal and a voice signal.

5. The system for aircraft auto transition from assigned spacing to visual separation of claim 1, wherein the visual separation symbology further comprises an outlined circle around the target aircraft representative of the RR.

6. The system for aircraft auto transition from assigned spacing to visual separation of claim 1, wherein the communication system further comprises an Automatic Dependent Surveillance-Broadcast (ADS-B) system including reception of a rebroadcast (ADS-R) and a traffic information service broadcast (TIS-B).

7. The system for aircraft auto transition from assigned spacing to visual separation of claim 1, wherein the assigned spacing application further comprises a Flight deck Interval Management system (FIM) and the visual separation application further comprises one of a Cockpit Display of Traffic Information (CDTI)-Assisted Visual Separation (CAVS) application and a CDTI-Assisted Separation (CAS).

8. The system for aircraft auto transition from assigned spacing to visual separation of claim 1, wherein the cockpit display further comprises a multi-function display (MFD) operationally coupled with the ownship aircraft, a portable display, and a tablet display, each of the portable display and the tablet display one of: in data connectivity with the ownship aircraft and in data connectivity with one of the communication system and a navigation system.

9. The system for aircraft auto transition from assigned spacing to visual separation of claim 1, wherein the controller further comprises one of: a portion and a partition of one of: a mission computer (MC), a flight control computer (FCC), a flight management system (FMS), a traffic computer (TC), and a flight deck display management computer (DMC).

10. The system for aircraft auto transition from assigned spacing to visual separation of claim 1, wherein the indication of either the assigned spacing application or the visual separation application further includes a message on the PFD.

11. The system for aircraft auto transition from assigned spacing to visual separation of claim 10, wherein the message on the PFD is an abbreviated message.

12. The system for aircraft auto transition from assigned spacing to visual separation of claim 1, further including a visual transition between the assigned spacing symbology and the visual separation symbology at the auto transition, the visual transition including an indication of the auto transition including one of an intermittent flash of the assigned spacing symbology and an intermittent flash of the assigned spacing data block.

13. The system for aircraft auto transition from assigned spacing to visual separation of claim 12, wherein the visual transition further includes an intermittent flash of the outlined circle around the target aircraft representative of the RR.

14. A method for aircraft auto transition from assigned spacing to visual separation, comprising:

receiving, via a communication system onboard an ownship aircraft, a position, an altitude, an identification, and a velocity of a target aircraft;

receiving an interval clearance assigning the target aircraft as an interval for the ownship aircraft, the interval clearance associated with at least one of an assigned spacing application and a visual separation application, the interval clearance including a termination point (TP);

displaying, on a cockpit display, an assigned spacing data block and an assigned spacing symbology, each associated with the assigned spacing application;

displaying, on the cockpit display, an auto option for a user selection of an auto transition from the assigned spacing application to the visual separation application;

receiving the user selection of the auto transition;

displaying, on the cockpit display, a range option for the user selection of a reference range for visual separation (RR) between the ownship aircraft and the target aircraft, the RR one of: a distance to the target aircraft at the TP and a user selectable range to the target aircraft;

receiving the user selection of the RR;

in response to the user selection of the auto transition, automatically transitioning from the assigned spacing application to the visual separation application at the TP without the user selection, the automatic transition including a data handover from the assigned spacing application to the visual separation application, the data handover including the RR and the position, the altitude, the identification, and the velocity of the target aircraft;

discontinuing the display of the assigned spacing data block and the assigned spacing symbology on the cockpit display; and in response to the user selection of the RR, displaying, on the cockpit display, a visual separation data block and a visual separation symbology, each associated with the visual separation application.

15. The method for aircraft auto transition from assigned to visual separation of claim 14, wherein the assigned spacing application further comprises a flight deck interval management system (FIM) and the visual separation application further comprises a Cockpit Display of Traffic Information (CDTI)-Assisted Visual Separation (CAVS) application, and a CDTI-Assisted Separation (CAS).

* * * * *